US007719188B2

(12) United States Patent
Ryu et al.

(10) Patent No.: US 7,719,188 B2
(45) Date of Patent: May 18, 2010

(54) PLASMA DISPLAY APPARATUS

(75) Inventors: Seonghwan Ryu, Gumi-si (KR); Kirack Park, Gyeongsangbuk-do (KR); Jongwoon Bae, Gumi-si (KR)

(73) Assignee: LG Electronics Inc., Seoul (KR)

( * ) Notice: Subject to any disclaimer, the term of this patent is extended or adjusted under 35 U.S.C. 154(b) by 678 days.

(21) Appl. No.: 11/649,779

(22) Filed: Jan. 5, 2007

(65) Prior Publication Data

US 2008/0030134 A1 Feb. 7, 2008

(30) Foreign Application Priority Data

Aug. 7, 2006 (KR) ..... 10-2006-0074438

(51) Int. Cl.
*H01J 17/49* (2006.01)

(52) U.S. Cl. ..... 313/582; 313/112

(58) Field of Classification Search ..... None
See application file for complete search history.

(56) References Cited

U.S. PATENT DOCUMENTS

| | | | | |
|---|---|---|---|---|
| 7,196,471 | B2 * | 3/2007 | Hirota et al. | 313/582 |
| 2003/0184225 | A1 * | 10/2003 | Namiki et al. | 313/582 |
| 2006/0152127 | A1 * | 7/2006 | Kawanami et al. | 313/112 |
| 2006/0250064 | A1 | 11/2006 | Park et al. | 313/112 |

FOREIGN PATENT DOCUMENTS

| | | | |
|---|---|---|---|
| CN | 1518036 | A | 8/2004 |
| CN | 1800884 | A | 7/2006 |
| EP | 1 435 639 | A2 | 7/2004 |
| EP | 1 677 336 | A2 | 7/2006 |
| EP | 1 798 749 | A2 | 6/2007 |
| JP | 2000-056128 | A | 2/2000 |
| KR | 10-2003-0066179 | A | 8/2003 |
| KR | 10-2006-0052803 | A | 5/2006 |
| KR | 10-0579713 | B1 | 5/2006 |
| KR | 10-2006-0080116 | A | 7/2006 |
| KR | 10-2006-0082527 | A | 7/2006 |
| KR | 10-2006-0102291 | A | 9/2006 |
| WO | WO 2005/013664 | A1 | 2/2005 |

OTHER PUBLICATIONS

Chinese Office Action dated Apr. 3, 2009.
Chinese Office Action dated Sep. 25, 2009.

* cited by examiner

*Primary Examiner*—Ashok Patel
(74) *Attorney, Agent, or Firm*—KED & Associates, LLP

(57) ABSTRACT

A plasma display apparatus is disclosed. The plasma display apparatus includes a plasma display panel, on which an image is displayed, and a filter positioned in front of the plasma display panel. A discharge gas filled in the plasma display panel contains xenon (Xe) equal to or more than 10% based on total weight of the discharge gas. The filter includes a base portion, and a pattern portion formed on the base portion, having a color darker than a color of the base portion.

18 Claims, 19 Drawing Sheets

| Lower width t1 of pattern portion | Upper width t2/2 of pattern portion | Aperture ratio | External light block |
|---|---|---|---|
| 23.0 μm | 23.0 μm | 50 % | ○ |
| 23.0 μm | 22.0 μm | 55 % | ○ |
| 23.0 μm | 20.0 μm | 60 % | ○ |
| 23.0 μm | 18.0 μm | 65 % | ○ |
| 23.0 μm | 16.0 μm | 70 % | ○ |
| 23.0 μm | 14.0 μm | 72 % | ○ |
| 23.0 μm | 12.0 μm | 75 % | ○ |
| 23.0 μm | 9.0 μm | 78 % | ○ |
| 23.0 μm | 8.0 μm | 80 % | ○ |
| 23.0 μm | 7.0 μm | 83 % | △ |
| 23.0 μm | 6.0 μm | 85 % | △ |
| 23.0 μm | 5.0 μm | 90 % | × |

FIG. 5c

| Lower width t1 of pattern portion / width of bus electrode | Moire fringe | External light block |
|---|---|---|
| 0.10 | △ | × |
| 0.15 | △ | × |
| 0.20 | × | △ |
| 0.25 | × | ○ |
| 0.30 | × | ○ |
| 0.35 | × | ○ |
| 0.40 | × | ○ |
| 0.45 | △ | ○ |
| 0.50 | △ | ○ |
| 0.55 | ○ | ○ |
| 0.60 | ○ | ○ |

FIG. 5d

| Height t3 of base portion | Height t2 of pattern portion | Dielectric breakdown | External light block |
|---|---|---|---|
| 120 μm | 120 μm | ○ | ○ |
| 120 μm | 115 μm | △ | ○ |
| 120 μm | 110 μm | × | ○ |
| 120 μm | 105 μm | × | ○ |
| 120 μm | 100 μm | × | ○ |
| 120 μm | 95 μm | × | ○ |
| 120 μm | 90 μm | × | ○ |
| 120 μm | 85 μm | × | ○ |
| 120 μm | 80 μm | × | ○ |
| 120 μm | 75 μm | × | △ |
| 120 μm | 70 μm | × | △ |
| 120 μm | 65 μm | × | △ |
| 120 μm | 60 μm | × | △ |
| 120 μm | 55 μm | × | △ |
| 120 μm | 50 μm | × | × |

FIG. 5e

| Lower width t1 of pattern portion / upper width of second barrier rib | Moire fringe | External light block |
|---|---|---|
| 0.10 | ○ | × |
| 0.15 | △ | × |
| 0.20 | △ | × |
| 0.25 | △ | × |
| 0.30 | × | △ |
| 0.35 | × | △ |
| 0.40 | × | ○ |
| 0.45 | × | ○ |
| 0.50 | × | ○ |
| 0.55 | × | ○ |
| 0.60 | × | ○ |
| 0.65 | × | ○ |
| 0.70 | △ | ○ |
| 0.75 | △ | ○ |
| 0.80 | △ | ○ |
| 0.85 | ○ | ○ |
| 0.90 | ○ | ○ |

PLASMA DISPLAY APPARATUS

This Nonprovisional application claims priority under 35 U.S.C. §119(a) on Patent Application No. 10-2006-0074438 filed in Korea on Aug. 7, 2006 the entire contents of which are hereby incorporated by reference.

BACKGROUND

1. Field

This document relates to a plasma display apparatus.

2. Description of the Background Art

A plasma display apparatus includes a plasma display panel including a plurality of electrodes, and a driver supplying a predetermined driving signal to the electrodes of the plasma display panel.

The plasma display panel includes a phosphor layer inside a discharge cell partitioned by barrier ribs. The driver supplies the predetermined driving signal to the discharge cell through the electrodes.

When the driving signal generates the discharge inside the discharge cells, a discharge gas filled in the discharge cells generates vacuum ultraviolet rays, which thereby cause phosphors formed inside the discharge cells to emit light, thus displaying an image on the screen of the plasma display panel.

SUMMARY

In one aspect, a plasma display apparatus comprises a plasma display panel on which an image is displayed, and a filter positioned in front of the plasma display panel, wherein a discharge gas filled in the plasma display panel contains xenon (Xe) equal to or more than 10% based on total weight of the discharge gas, wherein the filter includes a base portion, and a pattern portion formed on the base portion, having a color darker than a color of the base portion.

In another aspect, a plasma display apparatus comprises a plasma display panel on which an image is displayed, and a filter positioned in front of the plasma display panel, wherein a discharge gas filled in the plasma display panel contains xenon (Xe) equal to or more than 10% based on total weight of the discharge gas, wherein the filter includes a base portion, and a pattern portion formed on the base portion, wherein the height of the base portion ranges from 1.01 to 2.25 times the height of the pattern portion.

In still another aspect, a plasma display apparatus comprises a plasma display panel on which an image is displayed, and a filter positioned in front of the plasma display panel, wherein a discharge gas filled in the plasma display panel contains xenon (Xe) equal to or more than 10% based on total weight of the discharge gas, wherein the plasma display panel includes a front substrate on which a first electrode and a second electrode are formed in parallel to each other, and a rear substrate on which a third electrode is formed to intersect the first electrode and the second electrode, wherein the filter includes a base portion, and a pattern portion formed on the base portion, wherein a lower width of the pattern portion is less than the closest distance between the first electrode and the second electrode.

BRIEF DESCRIPTION OF THE DRAWINGS

The accompany drawings, which are included to provide a further understanding of the invention and are incorporated on and constitute a part of this specification, illustrate embodiments of the invention and together with the description serve to explain the principles of the invention.

FIGS. 5*a* to 5*e* illustrate a function of a pattern portion;

DETAILED DESCRIPTION OF PREFERRED EMBODIMENTS

Reference will now be made in detail embodiments of the invention examples of which are illustrated in the accompanying drawings.

Figure 1:
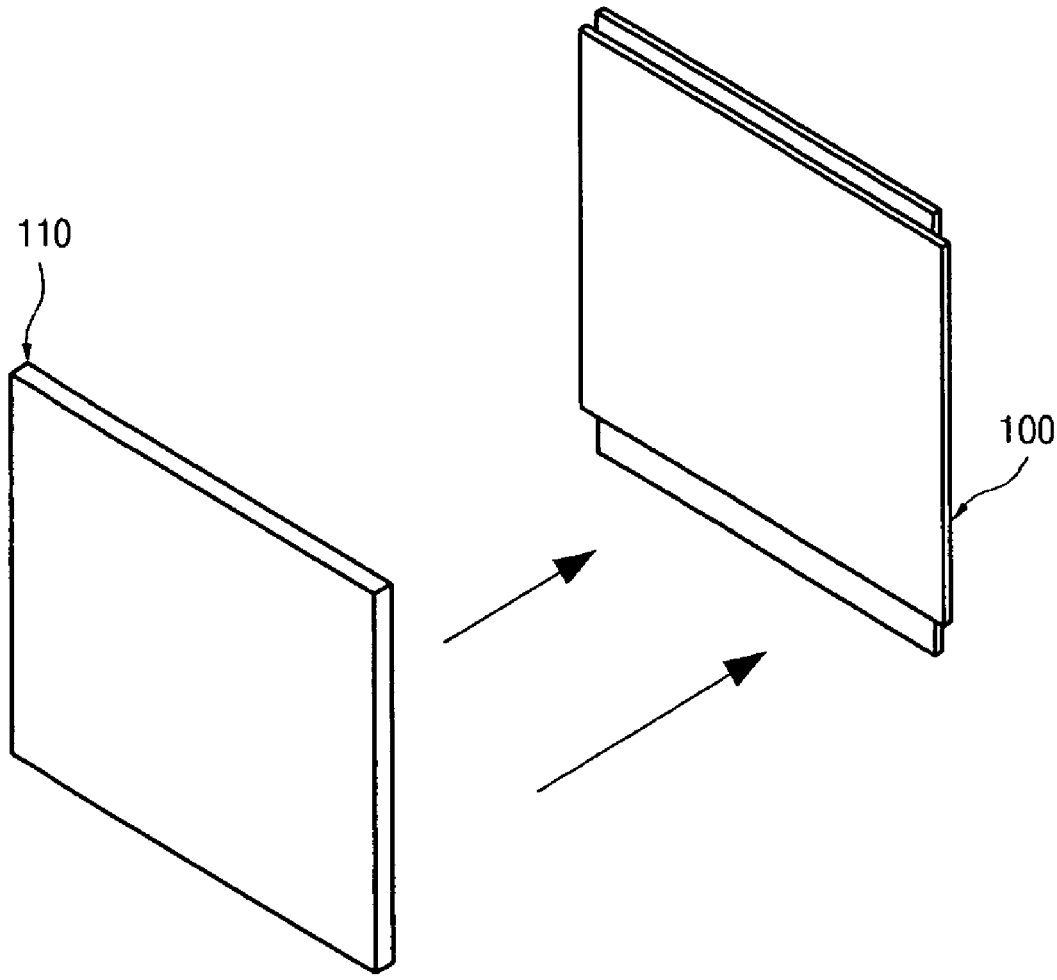
FIG. 1 illustrates one example of a configuration of a plasma display apparatus according to one embodiment.

FIG. 1 illustrates one example of a configuration of a plasma display apparatus according to one embodiment.

Referring to FIG. 1, the plasma display apparatus according to one embodiment includes a plasma display panel 100, on which an image is displayed, and a filter 110 positioned in front of the plasma display panel 100.

The filter 110 includes a base portion (not illustrated) and a pattern portion (not illustrated). The filter 110 will be described in detail later.

Figure 2A:
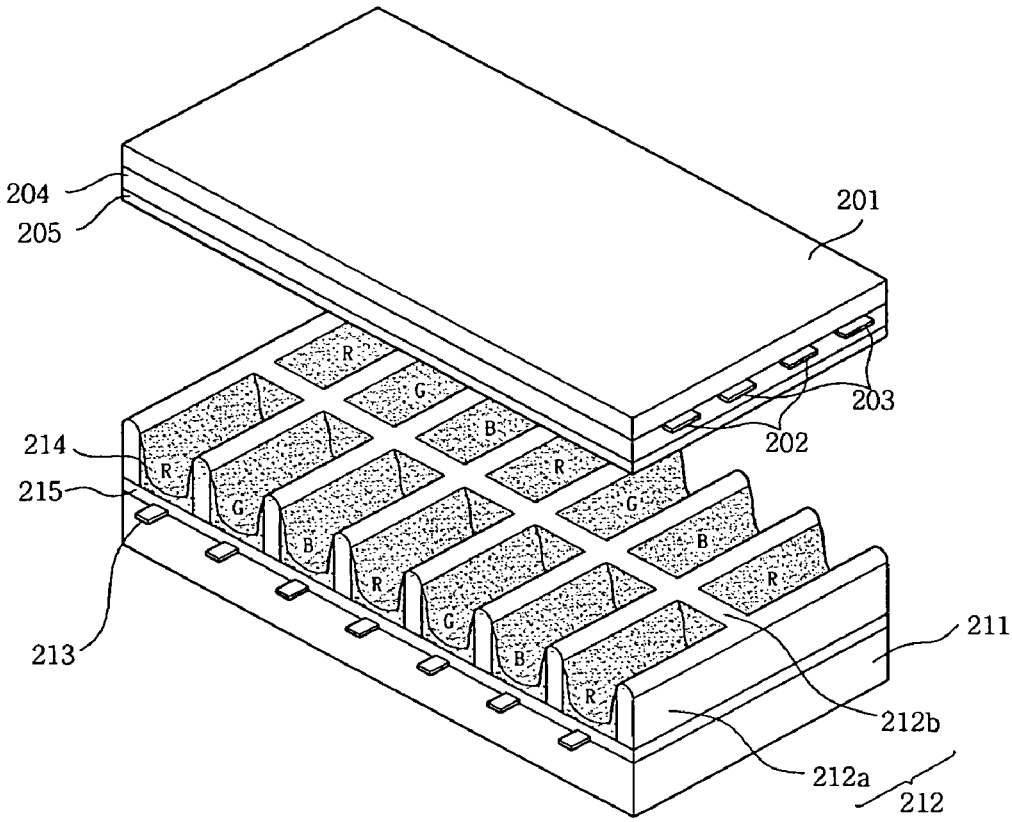
FIGS. 2*a* and 2*b* illustrate one example of a structure of a plasma display panel of the plasma display apparatus according to one embodiment.
Figure 2B:
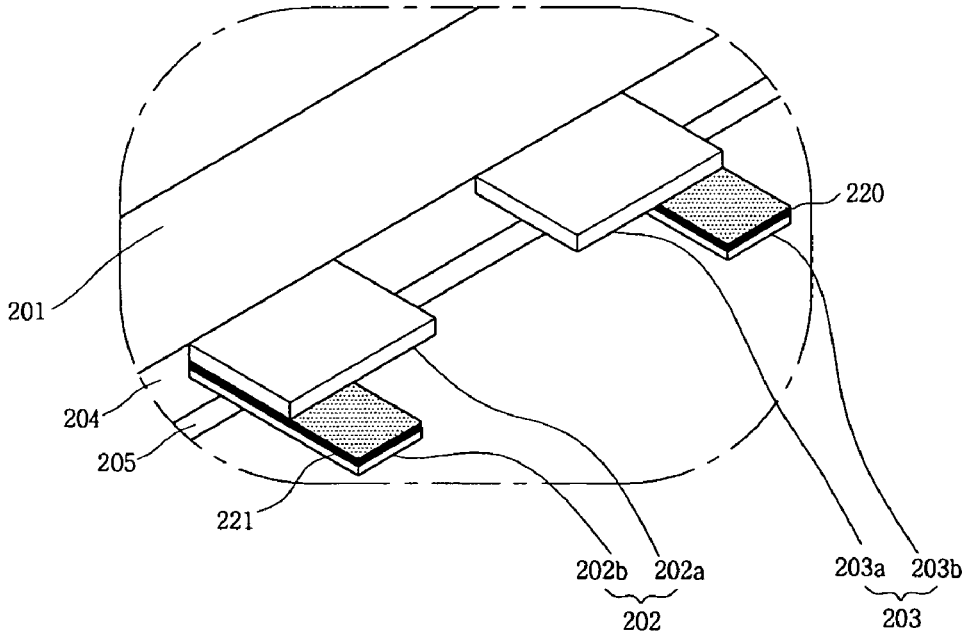

FIGS. 2*a* and 2*b* illustrate one example of a structure of a plasma display panel of the plasma display apparatus according to one embodiment.

Referring to FIG. 2*a*, the plasma display panel of the plasma display apparatus according to one embodiment includes a front substrate 201 and a rear substrate 211 which are coalesced with each other. On the front substrate 201, a first electrode 202 and a second electrode 203 are formed in parallel to each other. On the rear substrate 211, a third electrode 213 is formed to intersect the first electrode 202 and the second electrode 203.

The first electrode 202 and the second electrode 203 generate a discharge inside discharge spaces (i.e., discharge cells), and maintain the discharges of the discharge cells.

An upper dielectric layer 204 for covering the first electrode 202 and the second electrode 203 is formed on an upper portion of the front substrate 201 on which the first electrode 202 and the second electrode 203 are formed.

The upper dielectric layer 204 limits discharge currents of the first electrode 202 and the second electrode 203, and provides insulation between the first electrode 202 and the second electrode 203.

A protective layer 205 is formed on an upper surface of the upper dielectric layer 204 to facilitate discharge conditions. The protective layer 205 may be formed by deposing a material such as magnesium oxide (MgO) on an upper portion of the upper dielectric layer 204.

A lower dielectric layer 215 for covering the third electrode 213 is formed on an upper portion of the rear substrate 211 on which the third electrode 213 is formed. The lower dielectric layer 215 provides insulation of the third electrode 213.

Barrier ribs 212 of a stripe type, a well type, a delta type, a honeycomb type, and the like, are formed on an upper portion of the lower dielectric layer 215 to partition the discharge spaces (i.e., discharge cells). A red (R) discharge cell, a green (G) discharge cell, and a blue (B) discharge cell, and the like, are formed between the front substrate 201 and the rear substrate 211.

In addition to the red (R), green (G), and blue (B) discharge cells, a white (W) discharge cell or a yellow (Y) discharge cell may be further formed between the front substrate 201 and the rear substrate 211.

Pitches of the red (R), green (G), and blue (B) discharge cells may be substantially equal to one another. However, the pitches of the red (R), green (G), and blue (B) discharge cells may be different from one another to control a white balance in the red (R), green (G), and blue (B) discharge cells.

In this case, the pitches of all of the red (R), green (G), and blue (B) discharge cells may be different from one another, or alternatively, the pitch of at least one of the red (R), green (G), and blue (B) discharge cells may be different from the pitches of the other discharge cells. For instance, a pitch of the red (R) discharge cell may be the smallest, and pitches of the green (G) and blue (B) discharge cells may be more than the pitch (a) of the red (R) discharge cell.

The pitch of the green (G) discharge cell may be substantially equal to or different from the pitch of the blue (B) discharge cell.

The plasma display panel according one embodiment may have various forms of barrier rib structures as well as a structure of the barrier rib 212 illustrated in FIG. 2*a*. For instance, the barrier rib 212 includes a first barrier rib 212*b* and a second barrier rib 212*a*. The barrier rib 212 may have a differential type barrier rib structure in which the height of the first barrier rib 212*b* and the height of the second barrier rib 212*a* are different from each other, a channel type barrier rib structure in which a channel usable as an exhaust path is formed on at least one of the first barrier rib 212*b* or the second barrier rib 212*a*, a hollow type barrier rib structure in which a hollow is formed on at least one of the first barrier rib 212*b* or the second barrier rib 212*a*, and the like.

In the differential type barrier rib structure, a height h1 of the first barrier rib 212*b* may be less than a height h2 of the second barrier rib 212*a*. Further, in the channel type barrier rib structure or the hollow type barrier rib structure, a channel or a hollow may be formed on the first barrier rib 212*b*.

While the plasma display panel according to one embodiment has been illustrated and described to have the red (R), green (G), and blue (B) discharge cells arranged on the same line, it is possible to arrange them in a different pattern. For instance, a delta type arrangement in which the red (R), green (G), and blue (B) discharge cells are arranged in a triangle shape may be applicable. Further, the discharge cells may have a variety of polygonal shapes such as pentagonal and hexagonal shapes as well as a rectangular shape.

Each of the discharge cells partitioned by the barrier ribs 212 is filled with a predetermined discharge gas. The discharge gas contains xenon (Xe) equal to or more than 10% based on total weight of the discharge gas. The discharge gas may contain xenon (Xe) of 13-30% based on total weight of the discharge gas.

A gas pressure inside the discharge cell may be equal to 500 torr or 450 torr.

The discharge gas and the gas pressure will be described in detail later.

Phosphor layers 214 for emitting visible light for an image display when generating an address discharge are formed inside the discharge cells partitioned by the barrier ribs 212. For instance, red (R), green (G) and blue (B) phosphor layers may be formed inside the discharge cells.

A white (W) phosphor layer and/or a yellow (Y) phosphor layer may be further formed in addition to the red (R), green (G) and blue (B) phosphor layers.

The thicknesses (widths) of the phosphor layers 214 formed inside the red (R), green (G) and blue (B) discharge cells may be substantially equal to one another. Or, the thickness of the phosphor layer 214 in at least one of the red (R), green (G) and blue (B) discharge cells may be different from the thicknesses of the phosphor layers 214 in the other discharge cells. For instance, the thickness of the phosphor layer in the green (G) or blue (B) discharge cell may be more than the thickness of the phosphor layer in the red (R) discharge cell. The thickness of the phosphor layer 214 in the green (G) discharge cell may be substantially equal to or different from the thickness of the phosphor layer 214 in the blue (B) discharge cell.

Although FIG. 2*a* has illustrated and described a case where the first electrode 202 and the second electrode 203 each include a single layer, at least one of the first electrode 202 or the second electrode 203 may include a plurality of layers. This will be described in detail with reference to FIG. 2*b*.

Referring to FIG. 2*b*, the first electrode 202 and the second electrode 203 each include a plurality of layers, for example, two layers.

Light transmissivity and electrical conductivity of the first electrode 202 and the second electrode 203 need to be considered to emit light generated within the discharge cell to the outside of the plasma display panel and to secure driving efficiency. Accordingly, the first electrode 202 and the second electrode 203 each include transparent electrodes 202*a* and 203*a* made of a transparent material, for example, indium-tin-oxide (ITO), and bus electrodes 202*b* and 203*b* made of an opaque material, for example, Ag.

As above, since the first electrode 202 and the second electrode 203 each include the transparent electrodes 202*a* and 203*a*, visible light generated within the discharge cell is effectively emitted to the outside of the plasma display panel.

Furthermore, in a case where the first electrode 202 and the second electrode 203 each include only the transparent electrodes 202*a* and 203*a*, electrical conductivity of the transparent electrodes 202*a* and 203*a* is relatively low, thereby reducing driving efficiency. However, the first electrode 202 and the second electrode 203 further include the bus electrodes 202*b* and 203*b*, the low electrical conductivity of the transparent electrodes 202*a* and 203*a* causing a reduction in the driving efficiency is compensated.

It should be noted that only one example of the plasma display panel of the plasma display apparatus according to one embodiment has been illustrated and described above, and the embodiment is not limited to the plasma display panel of the above-described structure. For instance, although the above description illustrates a case where the upper dielectric layer 204 and the lower dielectric layer 215 each are formed in the form of a single layer, at least one of the upper dielectric layer 204 and the lower dielectric layer 215 may be formed in the form of a plurality of layers.

A black layer (not illustrated) for absorbing external light may be further formed on the upper portion of the barrier rib 212 to prevent the reflection of the external light caused by the barrier rib 212.

Further, another black layer (not illustrated) may be further formed at a predetermined position on the front substrate 201 corresponding to the barrier rib 212.

The third electrode 213 formed on the rear substrate 211 may have a substantially constant width or thickness. Further, the width or thickness of the third electrode 213 inside the discharge cell may be different from the width or thickness of the third electrode 213 outside the discharge cell. For instance, the width or thickness of the third electrode 213 inside the discharge cell may be more than the width or thickness of the third electrode 213 outside the discharge cell.

In this way, the structure of the plasma display panel according to one embodiment may be changed in various ways.

Since the front substrate 210 described above is made of a glass material, it is a great likelihood of a damage to the front substrate 210 by an external impact.

To prevent the damage, a buffer is further formed between the plasma display panel 100 and the filter. The following is a detailed description of the buffer, with reference to FIG. 3.

Figure 3:
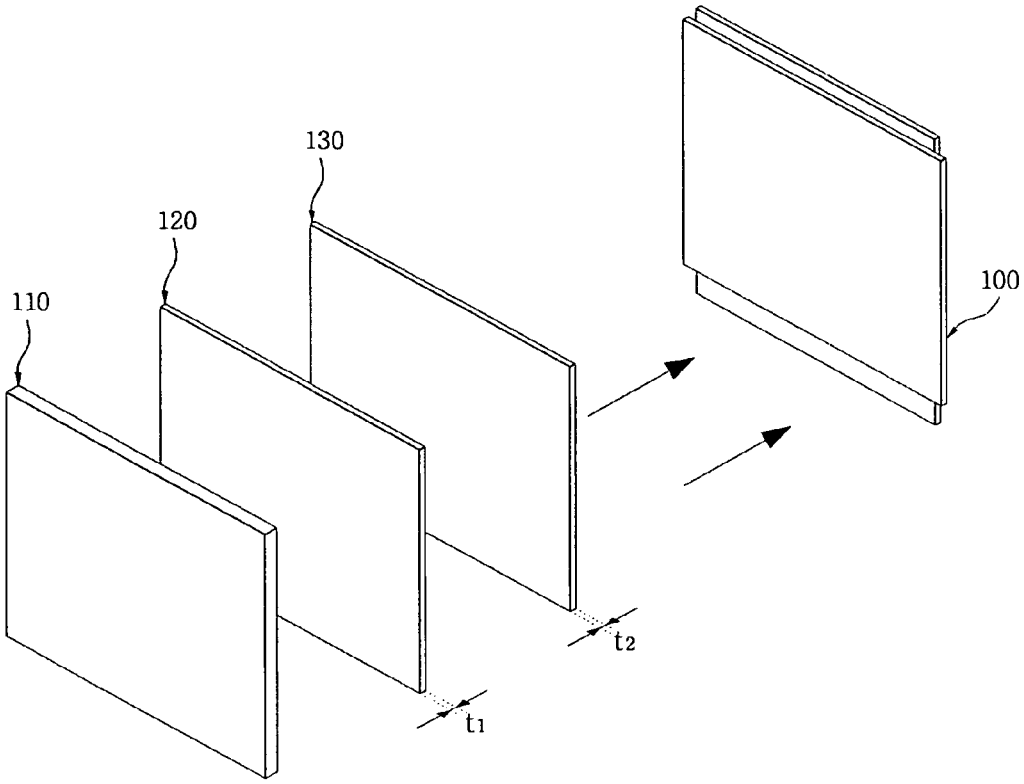
FIG. 3 illustrates the plasma display apparatus according to one embodiment further including a buffer between the plasma display panel and a filter.

FIG. 3 illustrates the plasma display apparatus according to one embodiment further including a buffer between the plasma display panel and a filter.

Referring to FIG. 3, one or more buffers 120 and 130 are formed between the plasma display panel 100 and the filter 110. The buffers 120 and 130 may include a material such as resin or glass.

The buffers 120 and 130 absorb an impact applied to the plasma display panel 100 from the outside, thereby protecting the plasma display panel 100. To more efficiently protect the plasma display panel 100, at least one of thicknesses t1 and t2 of the buffers 120 and 130 may range from 200 μm to 400 μm.

The buffers 120 and 130 may include an impact resistance film.

For example, the buffer 120 may include an impact resistance film, and the buffer 130 may include a resin material.

While the number of buffers is two in FIG. 3, one, three or four buffers may be formed. The number of buffers may be controlled variously.

Figure 4:
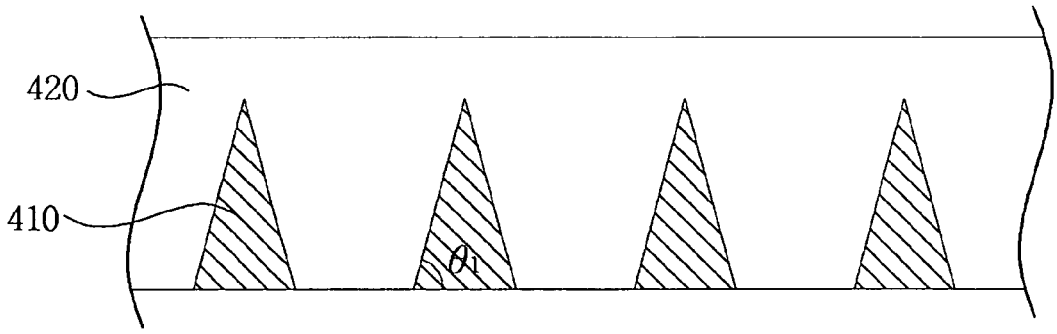
FIG. 4 illustrates one example of a filter of the plasma display apparatus according to one embodiment.

FIG. 4 illustrates one example of a filter of the plasma display apparatus according to one embodiment.

Referring to FIG. 4, the filter of the plasma display apparatus according to one embodiment includes a pattern portion 410 and a base portion 420.

The pattern portion 410 is formed on the base portion 420. The number of pattern portions 410 is plural, and the plurality of pattern portions 410 are positioned to be spaced with a predetermined distance therebetween. The pattern portion 410 includes a light absorption material. The light absorption material includes at least one of carbon, pigment, or dyes.

A refraction index of the base portion 420 may be more than a refraction index of the pattern portion 410. For example, assuming that a refraction index of the pattern portion 410 is equal to a first refraction index, a refraction index of the base portion 420 is equal to a second refraction index more than the first refraction index. The base portion 420 may include a transparent material.

A color of the pattern portion 410 may be darker than a color of the base portion 420. For example, the color of the pattern portion 410 may be black. As the pattern portion 410 goes toward the base portion 420, the width of the pattern portion 410 gradually decreases. For example, the section shape of the pattern portion 410 is approximately an isosceles triangle.

Accordingly, one surface of the base portion 420 parallel to the base of the pattern portion 410 and the pattern portion 410 form a predetermined angle θ1. The angle θ1 may be equal to or more than about 70° and less than about 90°.

FIGS. 5*a* to 5*e* illustrate a function of a pattern portion.

Figures 5A, 5B:
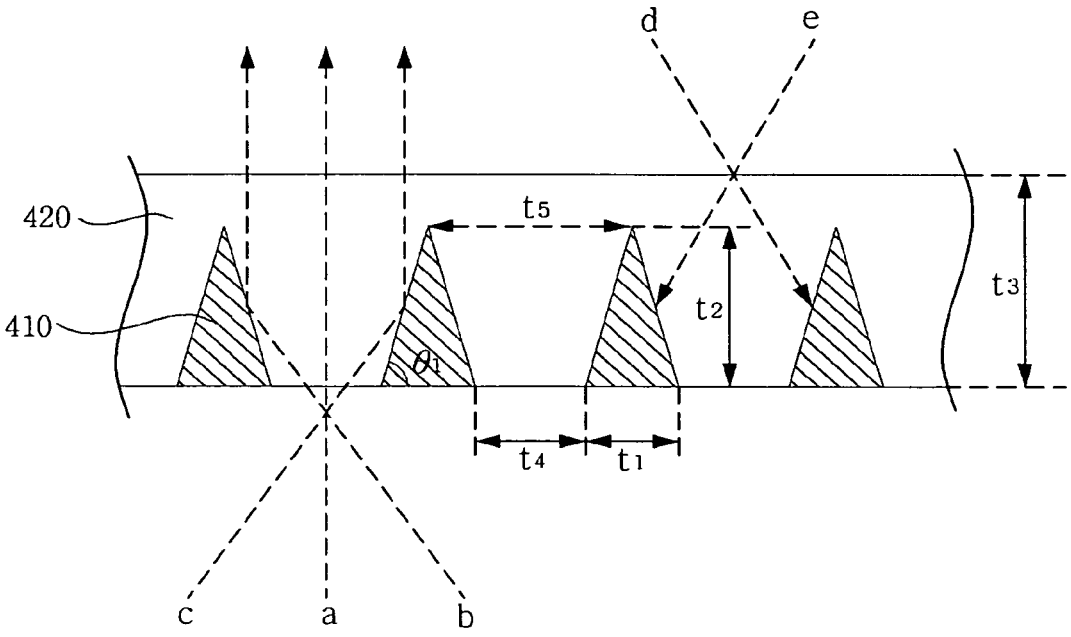

Referring to FIG. 5*a*, light generated at a point "a" positioned at the inside of the filter directly is emitted to the outside. Light generated at points "b" and "c" positioned at the inside of the filter is totally reflected by the pattern portion 410 and then emitted to the outside.

However, light entered from points "d" and "e" positioned at the outside of the filter is absorbed into the pattern portion 410. This occurs because the refractive index of the pattern portion 410 is less than the refractive index of the base portion 420 and one surface of the base portion 420 parallel to the base of the pattern portion 410 and the pattern portion 410 form the predetermined angle θ1.

As light generated at the inside of the filter is effectively emitted to the outside and light entered from the outside of the filter is absorbed, contrast of an image displayed on the plasma display panel is improved.

To more effectively absorb light entered from the outside of the filter and to more effectively emit light generated at the inside of the filter, the refractive index of the pattern portion 410 is 0.8 to 0.999 times the refractive index of the base portion 420.

An upper area of the pattern portion is farther from the plasma display panel than a bottom area of the pattern portion. The width (hereinafter, referred to an upper width) of the pattern portion 410 in the upper area is less than the width (hereinafter, referred to a lower width t1) of the pattern portion 410 in the bottom area. The upper width and the lower width t1 of the pattern portion 410 are set to sufficiently secure the block efficiency of light entered from the outside of the filter and the reflection efficiency of light generated at the inside of the filter.

For example, as illustrated in FIG. 5*b*, when the lower width t1 of the pattern portion 410 is set to 23.0 μm and the upper width of the pattern portion 410 is equal to or less than 23.0 μm, an aperture ratio that is equal to or more than 50% is secured. When the upper width of the pattern portion 410 is equal to or less than 8.0 μm, the block efficiency of light entered from the outside of the filter is reduced. When the height of the pattern portion 410 is t2, the upper width of the pattern portion 410 corresponds to half (t2/2) the height t2 of the pattern portion 410.

When the lower width t1 of the pattern portion 410 range from 1 to 3.5 times the upper width, it is advantageous to block external light and to secure the aperture ratio.

The lower width t1 of the pattern portion 410 may be less than the closest distance between the first electrode 202 and the second electrode 203 (refer to FIG. 2*a*). In this case, the block efficiency of light entered from the outside of the filter and the reflection efficiency of light generated at the inside of the filter increase.

The lower width t1 of the pattern portion 410 may depend on the width of each of the first electrode 202 and the second electrode 203. For example, as illustrated in FIG. 5*c*, when a ratio of the lower width t1 of the pattern portion 410 to the width of the bus electrodes 202*b* or 203*b* (refer to FIG. 2*b*) ranges from 0.2 to 0.5, an interference fringe (i.e., Moire fringe) generated when two or more periodic patterns overlap is prevented and the external light is blocked efficiently.

A ratio of a height t3 of the base portion 420 to the height t2 of the pattern portion 410 is set to block the external light and to prevent the dielectric breakdown.

For example, as illustrated in FIG. 5*d*, when the height t3 of the base portion 420 is set to 120 μm and the height t2 of the pattern portion 410 is equal to or more than 120 μm, the thickness of the base portion 420 decreases. As a result, it is a great likelihood of dielectric breakdown of the pattern portion 410 such that a defective proportion of a filter may increase. When the height t2 of the pattern portion 410 is equal to or less than 50 μm, light incident on the pattern portion 410 at a predetermined angle is not blocked such that the block efficiency of the external light decreases.

Accordingly, it is preferable that the height t3 of the base portion 420 ranges from 1.01 to 2.25 times the height t2 of the pattern portion 410.

A ratio of the lower width t1 of the pattern portion 410 to the width of the barrier rib is set to prevent Moire fringe and to sufficiently secure the block efficiency of the external light.

For example, as illustrated in FIG. 5*e*, when a ratio of the lower width t1 of the pattern portion 410 to the width of the second barrier rib 212*a* (refer to FIG. 2*a*) ranges from 0.3 to 0.8, the formation of Moire fringe is prevented and the external light is efficiently blocked.

Furthermore, the shortest gap t4 between the pattern portions 410 ranges from 1.1 to 5 times the lower width t1 of the pattern portion 410. Accordingly, an aperture ratio of the filter is sufficiently secured, light entered from the outside of the filter is sufficiently blocked, and manufacturing processes of the pattern portion 410 are easily performed.

Furthermore, the longest gap t5 between the pattern portions 410 ranges from 1.1 to 3.25 times the shortest gap t4 between the pattern portions 410. Accordingly, the aperture ratio of the filter is sufficiently secured, and the angle θ1 of the pattern portion 410 is set to an ideal value such that light entered from the outside of the filter is sufficiently blocked.

Furthermore, the height t2 of the pattern portion 410 ranges from 0.89 to 4.25 times the shortest gap t4 between the pattern portions 410. Accordingly, the aperture ratio of the filter is sufficiently secured, and light entered from the outside of the filter is sufficiently blocked.

For example, the lower width t1 of the pattern portion 410 ranges from 18 μm to 35 μm.

The height t2 of the pattern portion 410 ranges from 80 μm to 170 μm.

The height t3 of the base portion 420 ranges from 100 μm to 180 μm.

The shortest gap t4 between the pattern portions 410 ranges from 40 μm to 90 μm.

The longest gap t5 between the pattern portions 410 ranges from 90 μm to 130 μm.

FIGS. 6*a* to 6*e* illustrate other forms of pattern portions.

Figure 6A:
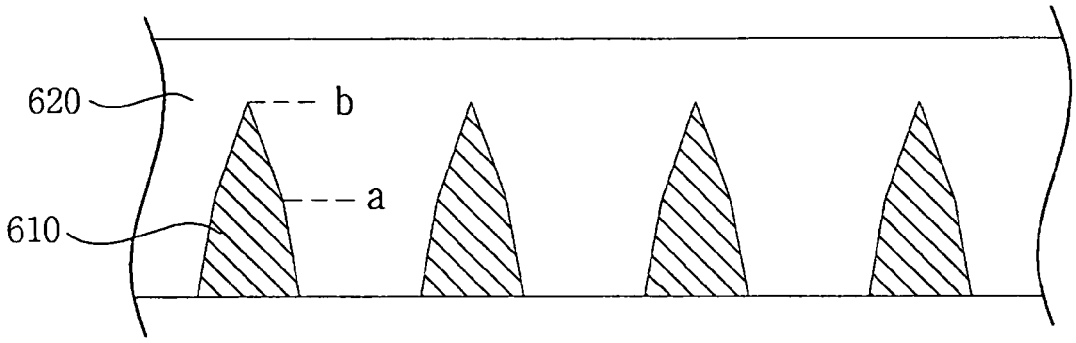
FIGS. 6*a* to 6*e* illustrate other forms of pattern portions.

Referring to FIG. 6*a*, a pattern portion 610 includes two portions each having a different width. For example, the pattern portion 610 has a first width at a point "a", and has a second width at a point "b" above the point "a". In other words, the width of the pattern portion 610 decreases with a first ratio up to the point "a", and decreases with a second ratio, that is more than the first ratio, from the point "a" to the point "b".

Figure 6B:
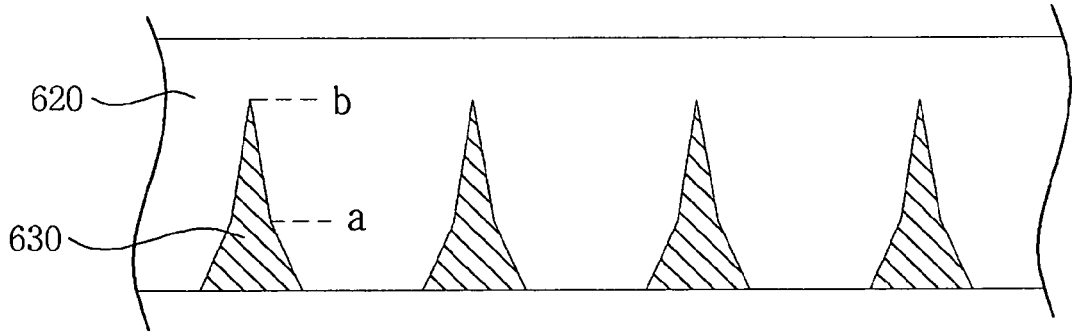

Referring to FIG. 6*b*, unlike FIG. 6*a*, the width of a pattern portion 630 decreases with a first ratio up to a point "a", and decreases with a second ratio, that is less than the first ratio, from the point "a" to a point "b".

Figure 6C:
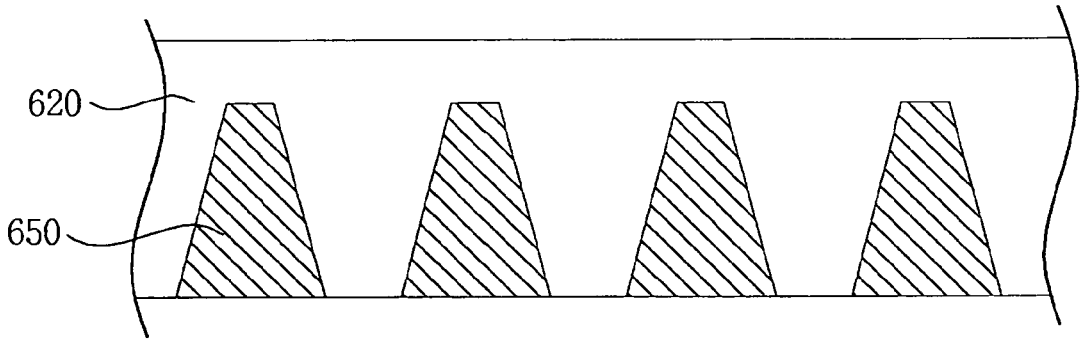

Referring to FIG. 6*c*, a tip of a pattern portion 650 has a substantially flat form.

Figure 6D:
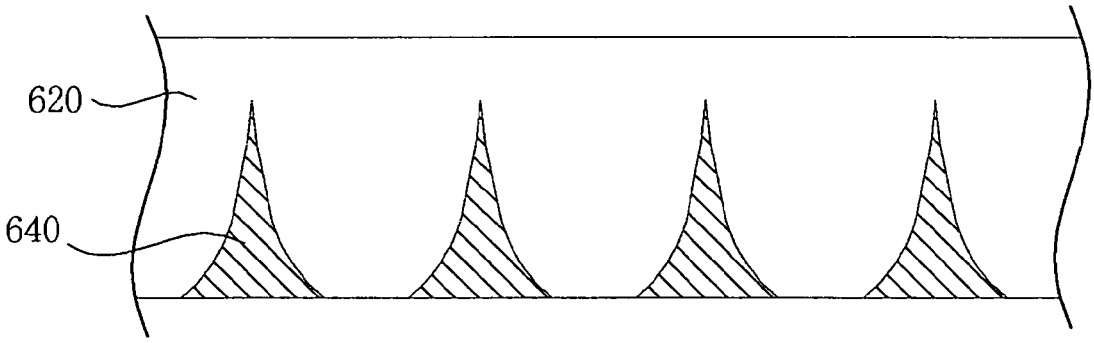

Referring to FIG. 6*d*, a side surface of the pattern portion 640 forms a smooth curved line.

Figure 6E:
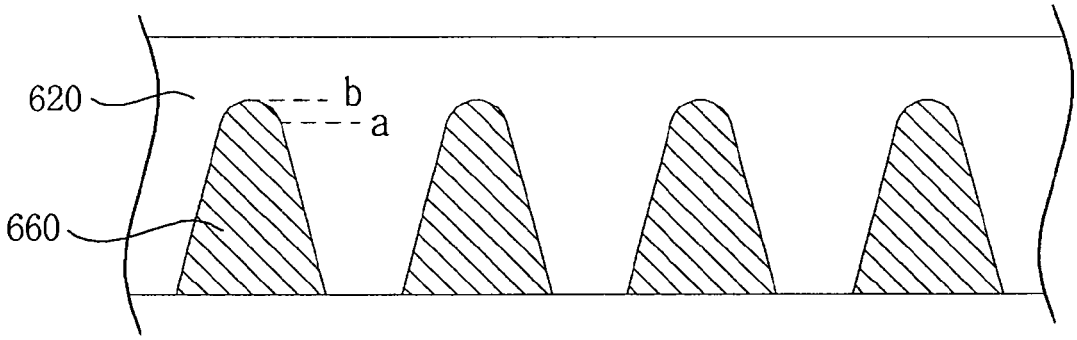

Referring to FIG. 6*e*, a side surface of the pattern portion 660 is a substantially straight line form up to a point "a" and is a curved line form from the point "a" to a point "b".

As described above, a form of the pattern portion may be variously changed.

Figure 7A:
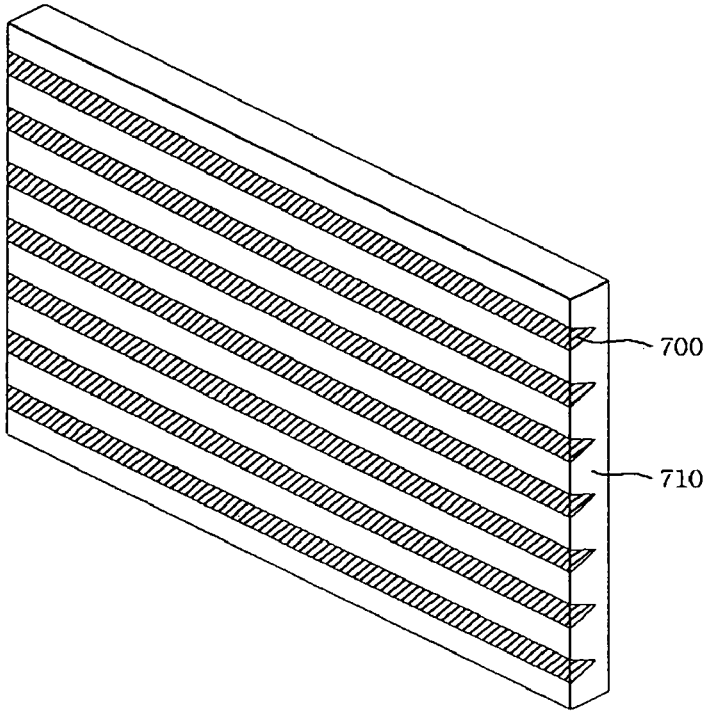
FIGS. 7*a* and 7*b* illustrate a traveling direction of a pattern portion.
Figure 7B:
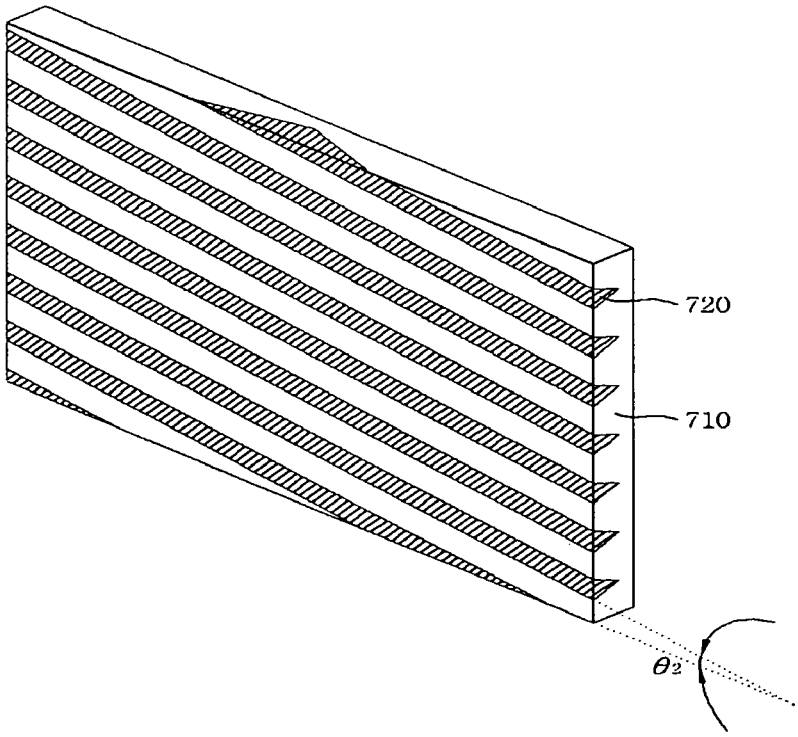

FIGS. 7*a* and 7*b* illustrate a traveling direction of a pattern portion.

Referring to FIG. 7*a*, a traveling direction of a pattern portion 700 and a long side of a base portion 710 are substantially parallel to each other.

Referring to FIG. 7*b*, a traveling direction of a pattern portion 720 and a long side of the base portion 710 form a predetermined angle θ2.

As above, when the traveling direction of the pattern portion 720 and the long side of the base portion 710 form the predetermined angle θ2, the generation of Moire fringe is efficiently prevented.

Furthermore, to more effectively prevent Moire fringe, the predetermined angle θ2 may range from 0.5° to 9° or from 0.5° to 4.5°.

While a stripe type of the pattern portion has been described above, a type of the pattern portion may be variously changed.

Figure 8A:
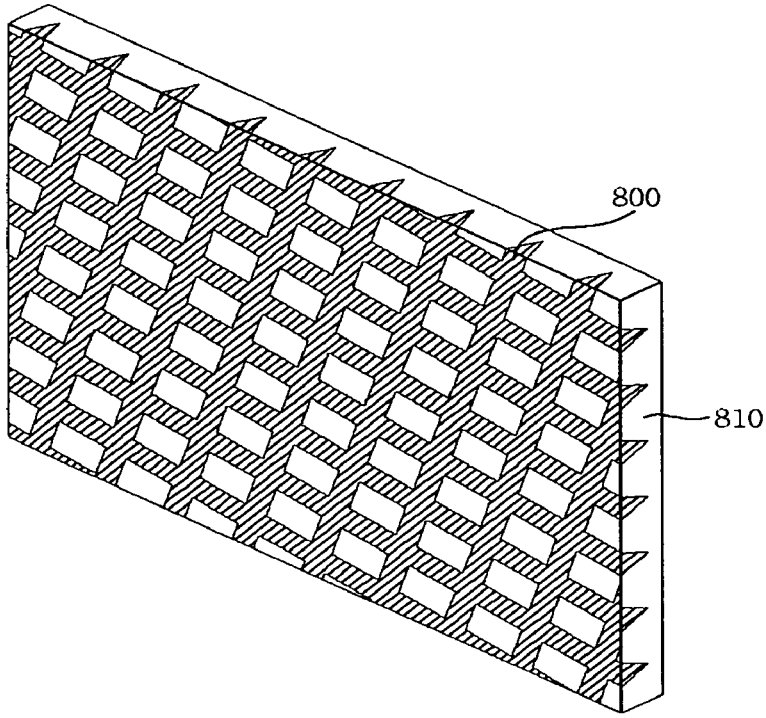
FIGS. 8*a* to 8*c* illustrate various types of pattern portions.
Figure 8B:
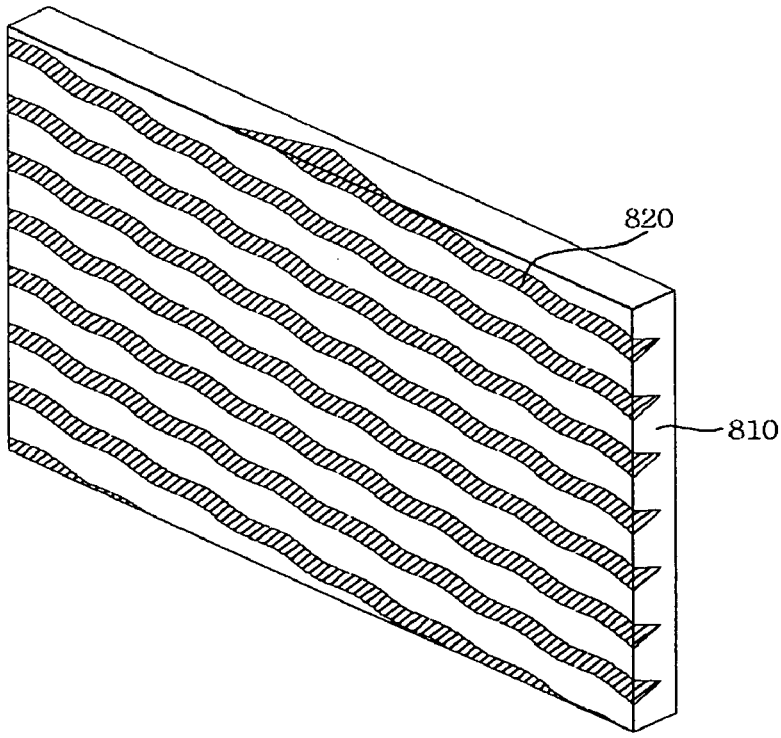
Figure 8C:
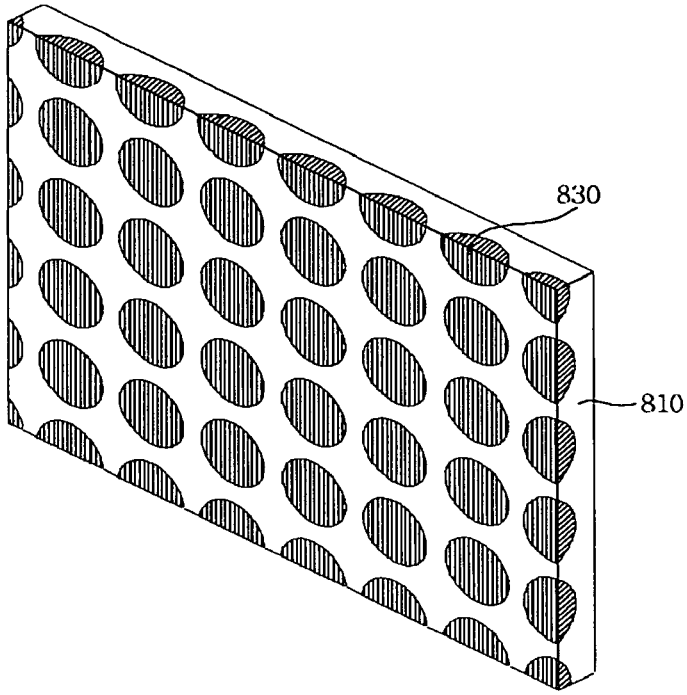

FIGS. 8*a* to 8*c* illustrate various types of pattern portions.

Referring to FIG. 8*a*, a pattern portion 800 is formed in a matrix type.

Referring to FIG. 8*b*, a pattern portion 820 is formed in a wave type.

Referring to FIG. 8*c*, a pattern portion 830 is formed in a protrusion type. For example, the plurality of the pattern portions 830 of a protrusion type having a hemisphere shape are spaced with a predetermined distance therebetween.

As described above, a type of the pattern portion may be variously changed.

Figure 9:
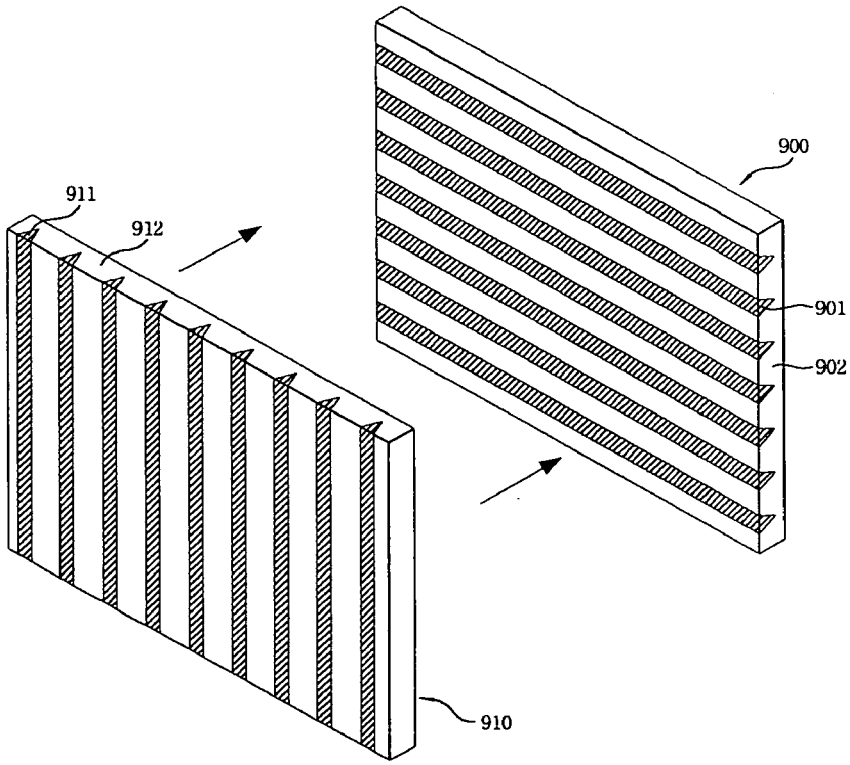
FIG. 9 illustrates one example of a case of using two or more pattern portions each having different patterns.

FIG. 9 illustrates one example of a case of using two or more pattern portions each having a different pattern.

Referring to FIG. 9, a first sheet 900 and a second sheet 910 may be included in one filter. The first sheet 900 includes a first base portion 902 and a first pattern portion 901 parallel to a long side of the first base portion 902. The second sheet 910 includes a second base portion 912 and a second pattern portion 911 parallel to a short side of the second base portion 912.

As above, when two or more pattern portions each having a different pattern are used together, a viewing angle of the plasma display panel is be variously controlled.

Figure 10:
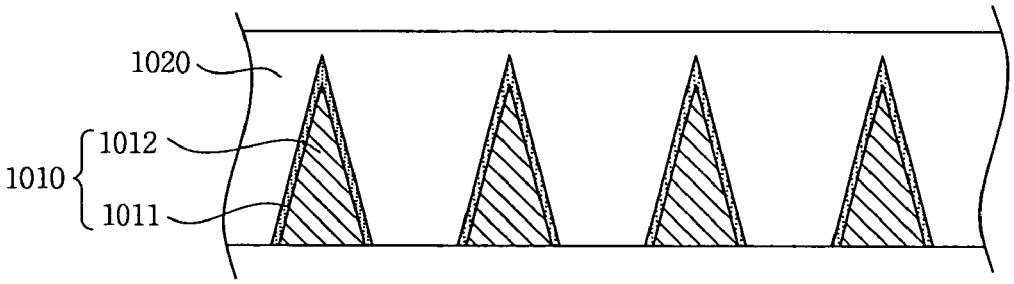
FIG. 10 illustrates another structure of a pattern portion.

FIG. 10 illustrates another structure of a pattern portion.

Referring to FIG. 10, a pattern portion 1010 has a plurality of layers. For example, the pattern portion 1010 includes an upper pattern portion 1011 and a lower pattern portion 1012. The upper pattern portion 1011 covers the lower pattern portion 1012.

A refractive index of the upper pattern portion 1011 may be less than a refractive index of a base portion 1020. A color of the upper pattern portion 1011 may be darker than a color of the base portion 1020.

A refractive index of the lower pattern portion 1012 may be different from or equal to the refractive index of the upper pattern portion 1011. For example, the refractive index of the lower pattern portion 1012 is less than the refractive index of the upper pattern portion 1011.

Figure 11A:
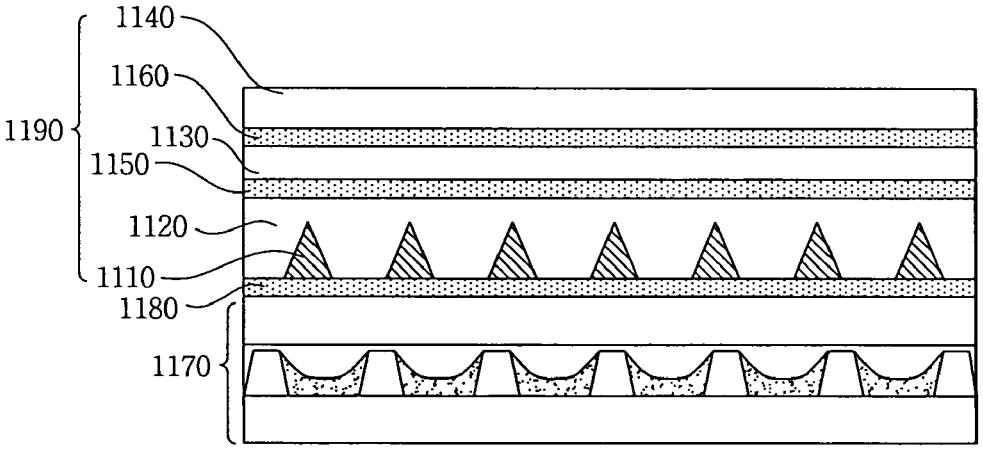
FIGS. 11*a* and 11*b* illustrate an application example of a filter including a pattern portion.
Figure 11B:
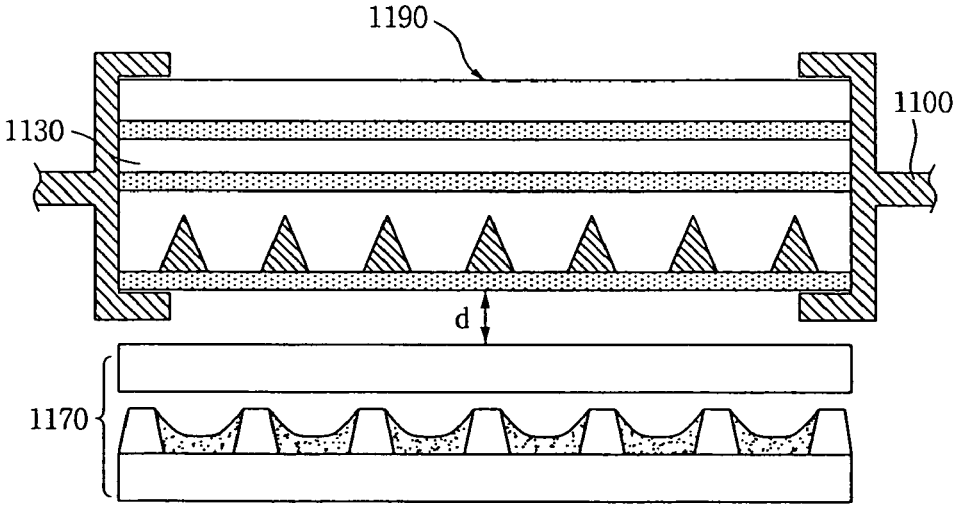

FIGS. 11*a* and 11*b* illustrate an application example of a filter including a pattern portion.

Referring to FIG. 11*a*, a first adhesive layer 1180 is formed on the front surface of a plasma display panel 1170, and a filter 1190 is adhered to the first adhesive layer 1180. For example, the filter 1190 is adhered to the front surface of the plasma display panel 1170 using a method such as laminating. The filter 1190 is a film type.

A reference numeral 1110 indicates a pattern portion, 1120 a base portion, 1130 a substrate, and 1140 an electromagnetic interference (EMI) shielding layer. When the filter is a film type, the substrate 1130 may be made of resin.

Furthermore, in the filter 1190, a second adhesive layer 1150 is formed between the base portion 1120 and the substrate 1130. A third adhesive layer 1160 is formed between the substrate 1130 and the EMI shielding layer 1140.

In a case where the first adhesive layer 1180 for adhering the filter 1190 and the plasma display panel 1170 is excessively thick, the emission of light generated in the plasma display panel 1170 to the outside may be prevented. Further, in a case where the first adhesive layer 1180 is excessively thin, an adhesive strength between the plasma display panel 1170 and the filter 1190 may be reduced.

Accordingly, the thickness of the first adhesive layer 1180 may range from about 10 μm to 50 μm or from about 20 μm to 40 μm.

Referring to FIG. 11*b*, the filter 1190 is spaced from the plasma display panel 1170 by a predetermined distance d. For example, the filter 1190 is supported by a supporter 1100 to be spaced from the plasma display panel 1170 by the predetermined distance d. In this case, the filter 1190 may be a glass type. When the filter 1190 is a glass type, the substrate 1130 may made of glass.

Figure 12A:
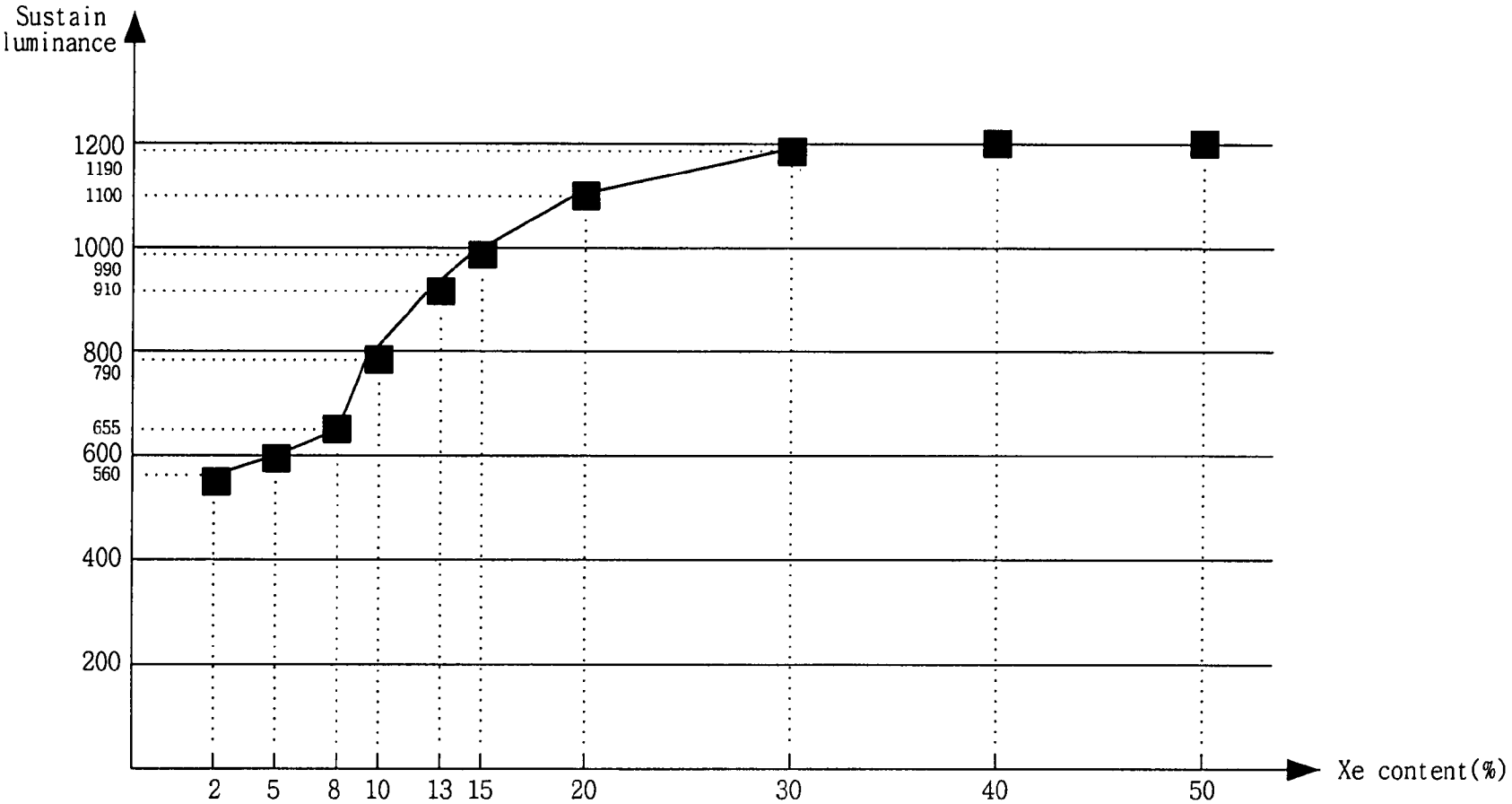
FIGS. 12*a* and 12*b* illustrate a xenon (Xe) content based on total weight of a discharge gas and a pressure of the discharge gas.
Figure 12B:
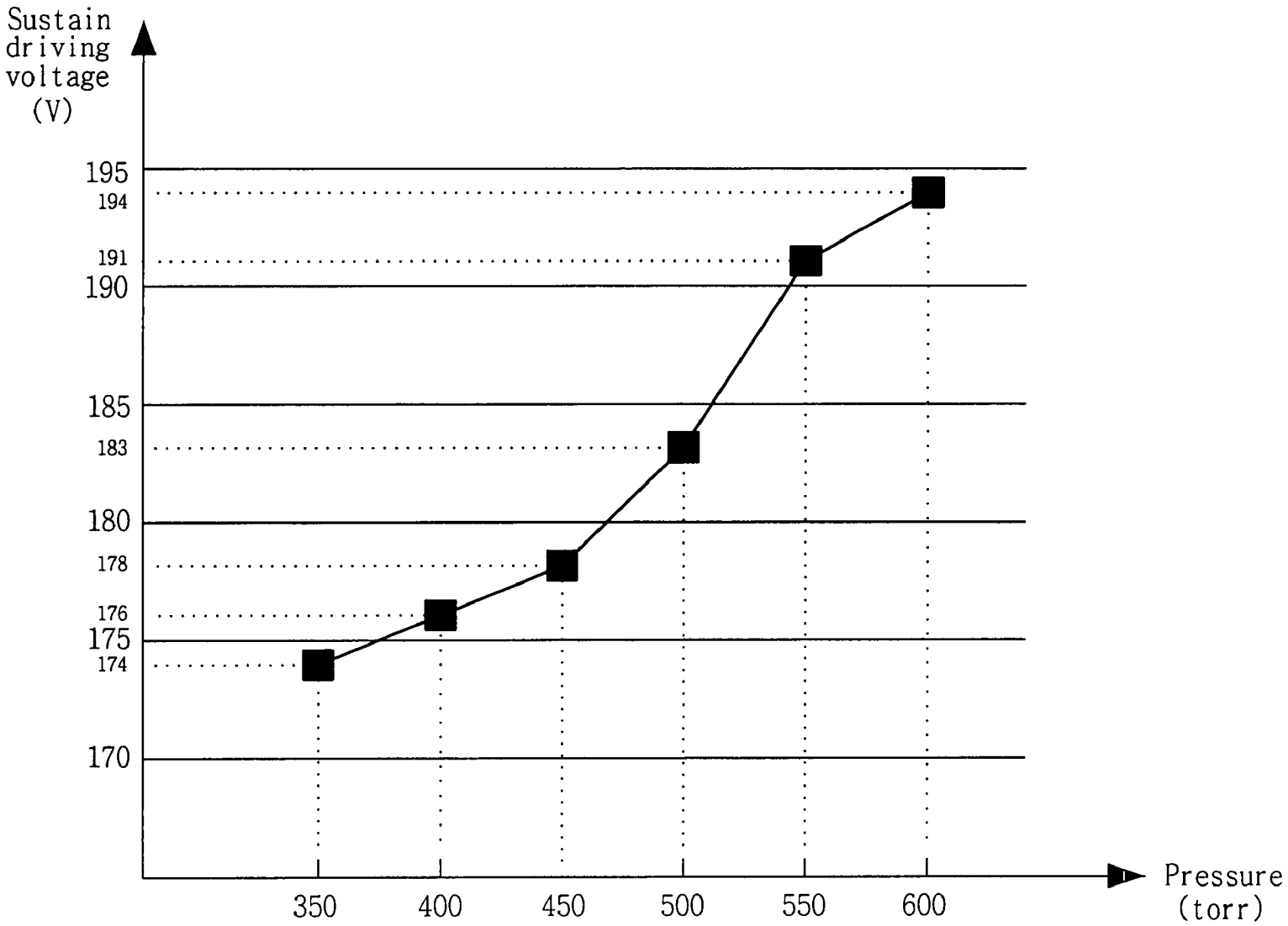

FIGS. 12*a* and 12*b* illustrate a xenon (Xe) content based on total weight of a discharge gas and a pressure of the discharge gas.

A discharge gas filled in the plasma display panel may contain xenon (Xe) equal to or more than 10% based on total weight of the discharge gas in a case of using a pattern portion which is described in one embodiment. A Xe content in the case of using the pattern portion may range from 13% to 30% based on total weight of the discharge gas.

More specifically, the above-described pattern portion absorbs light entered from the outside of the plasma display panel and emits light generated inside the plasma display panel to the outside of the plasma display panel, thereby improving a contrast characteristic. However, the pattern portion absorbs a portion of light generated inside the plasma display panel such that the whole luminance may be reduced.

To compensate a reduction in the luminance, the discharge gas filled in the plasma display panel contains Xe equal to or more than 10% based on total weight of the discharge gas.

More specifically, Xe increases the generation of ultra ultraviolet rays when generating a discharge in the plasma display panel. Therefore, as the Xe content in the discharge gas increases, the quantity of light generated in the discharge cell increases. This results in an increase in the luminance of an image displayed on the plasma display panel.

Accordingly, a reduction in the luminance caused by applying the pattern portion to the filter is compensated by setting the Xe content to be equal to or more than 10% based on total weight of the discharge gas.

Further, the Xe content in the case of using the pattern portion may range from 13% to 30% based on total weight of the discharge gas.

FIG. 12*a* is a graph illustrating changes in a sustain luminance of a sustain signal when the Xe content changes within the range of 2-50% based on total weight of the discharge gas in a case of using the pattern portion.

When the Xe content changes within the range of 2-8% based on total weight of the discharge gas in a case of using the pattern portion, the sustain luminance ranges from 560 to 655. On the other hand, when the Xe content is 10% based on total weight of the discharge gas, the sustain luminance increases to 790. In other words, a reduction in the luminance caused by the pattern portion is fully compensated by setting the Xe content to be equal to or more than 10% based on total weight of the discharge gas.

When the Xe content is 13% based on total weight of the discharge gas, the sustain luminance increases by about 135 from the sustain luminance obtained when the Xe content is 10%. When the Xe content is 30% based on total weight of the discharge gas, the sustain luminance constantly increases to 1190. When the Xe content is over 30% based on total weight of the discharge gas, the sustain luminance is saturated to 1200. In other words, a reduction in the luminance caused by the pattern portion is fully compensated by setting the Xe content to 13-30% based on total weight of the discharge gas.

Referring to FIG. 12*b*, a pressure of a discharge gas filled in the discharge cell may be equal to or less than 500 torr or may be equal to or less than 450 torr.

More specifically, as a Xe content in the discharge gas increases, a driving voltage may increase.

For example, when the Xe content is 2% based on total weight of the discharge gas, a firing voltage is 150V and it is assumed that the quantity of light generated by one driving signal is quantitatively equal to 100.

When the Xe content is 10% based on total weight of the discharge gas, the firing voltage is 250V and the quantity of light generated by one driving signal is quantitatively equal to 150.

In other words, as the Xe content increases, the quantity of light increases such that luminance increases. However, the firing voltage further increases.

To compensate an increase in the firing voltage, a gas pressure inside the discharge cell may be equal to or less than 500 torr. As above, by setting the gas pressure inside the discharge cell to be equal to or less than 500 torr, a movement of wall charges inside the discharge cell is activated such that the firing voltage decreases. Further, a gas pressure inside the discharge cell may be equal to or less than 450 torr.

FIG. 12*b* is a graph illustrating a change in sustain driving voltages when a pressure of a discharge gas changes within the range of 350-600 torr while the Xe content is about 15% based on total weight of the discharge gas.

When the pressure of the discharge gas changes within the range of 550-600 torr, a sustain driving voltage ranges from 191V to 194V. On the other hand, when the pressure of the discharge gas is 500 torr, the sustain driving voltage decreases to 183V. In other words, when the pressure of the discharge gas is equal to or less than 500 torr, the sufficiently low sustain driving voltage is obtained even if the Xe content is equal to or more than 10% based on total weight of the discharge gas.

When the pressure of the discharge gas is 450 torr, the sustain driving voltage decreases to 178V. In other words, as the pressure of the discharge gas is reduced, the sustain driving voltage gradually falls. When the pressure of the discharge gas is equal to or more than 450 torr, the sustain driving voltage falls more efficiently.

The plasma display apparatus according to one embodiment may further include a driver supplying a driving signal to the electrodes of the plasma display panel. The following is a detailed description of the driver, with reference to FIG. 13.

Figure 13:
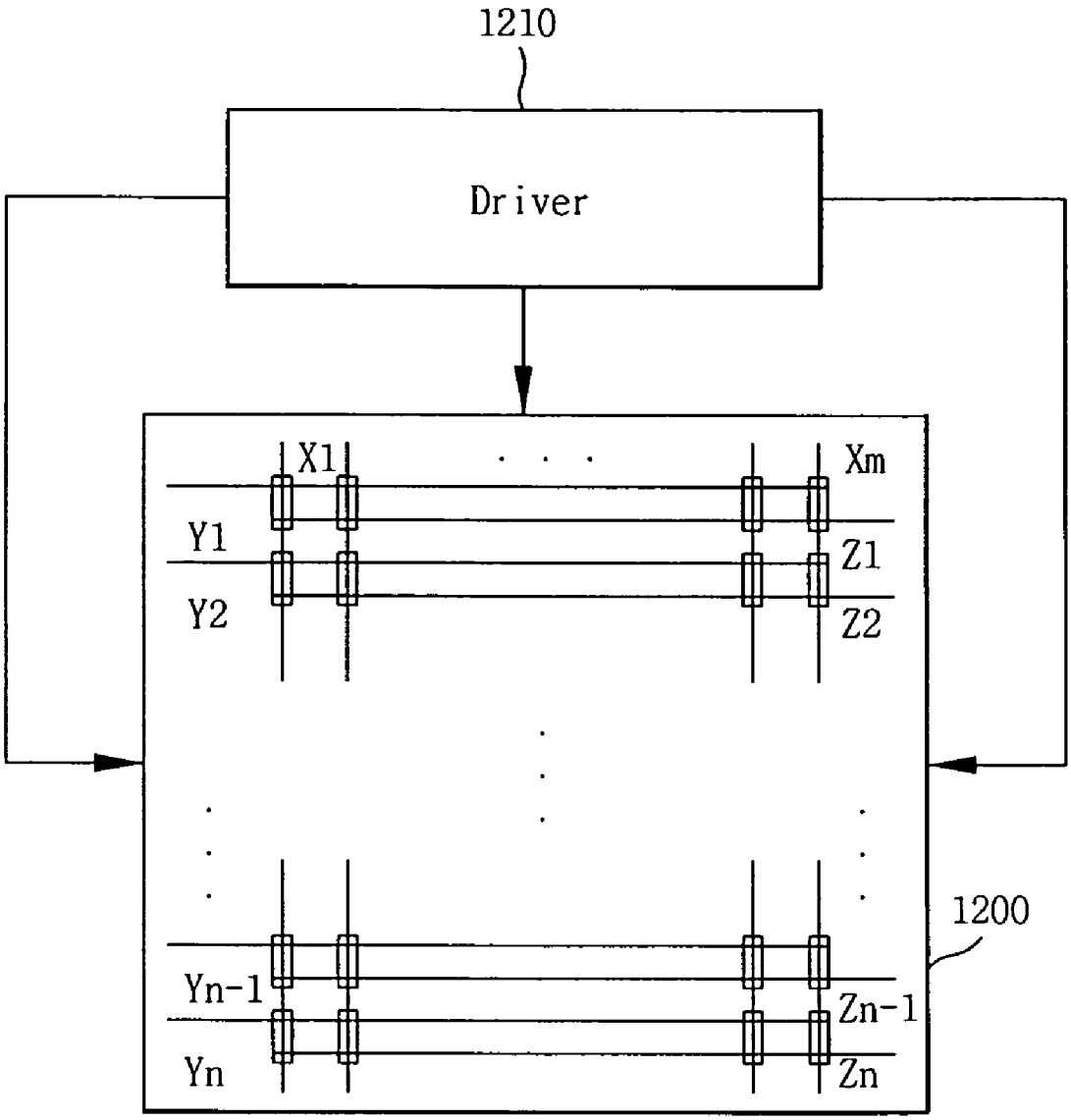
FIG. 13 illustrates one example of a configuration of the plasma display apparatus according to one embodiment including a driver.

FIG. 13 illustrates one example of a configuration of the plasma display apparatus according to one embodiment including a driver.

Referring to FIG. 13, the plasma display apparatus according to one embodiment includes a plasma display panel 1200 and a driver 1210.

Since the plasma display panel 1200 was described in detail with reference to FIGS. 2*a* and 2*b*, a description thereof is omitted.

The driver 1210 supplies a driving signal to a first electrode Y or a second electrode Z formed in the plasma display panel 1200. For example, the driver 1210 supplies a falling signal with a gradually falling voltage to the first electrode Y and a pre-sustain signal to the second electrode Z during a pre-reset period prior to a reset period of at least one of a plurality of subfields of a frame. A polarity direction of the falling signal is opposite to a polarity direction of the pre-sustain signal.

Although FIG. 13 has illustrated a case where the driver 1210 is formed in the form of a signal board, the driver 1210 may be formed in the form of a plurality of boards depending on the electrodes formed in the plasma display panel 1200.

For example, in a case where the first electrode Y and the second electrode Z are formed in parallel to each other and a third electrode X is formed to intersect the first and second electrodes in the plasma display panel 1200, the driver 1210 may include a first driver supplying a driving signal to the first electrode Y, a second driver supplying a driving signal to the second electrode Z, and a third driver supplying a driving signal to the third electrode X.

The driver 1210 will be described in detail below.

Figure 14:
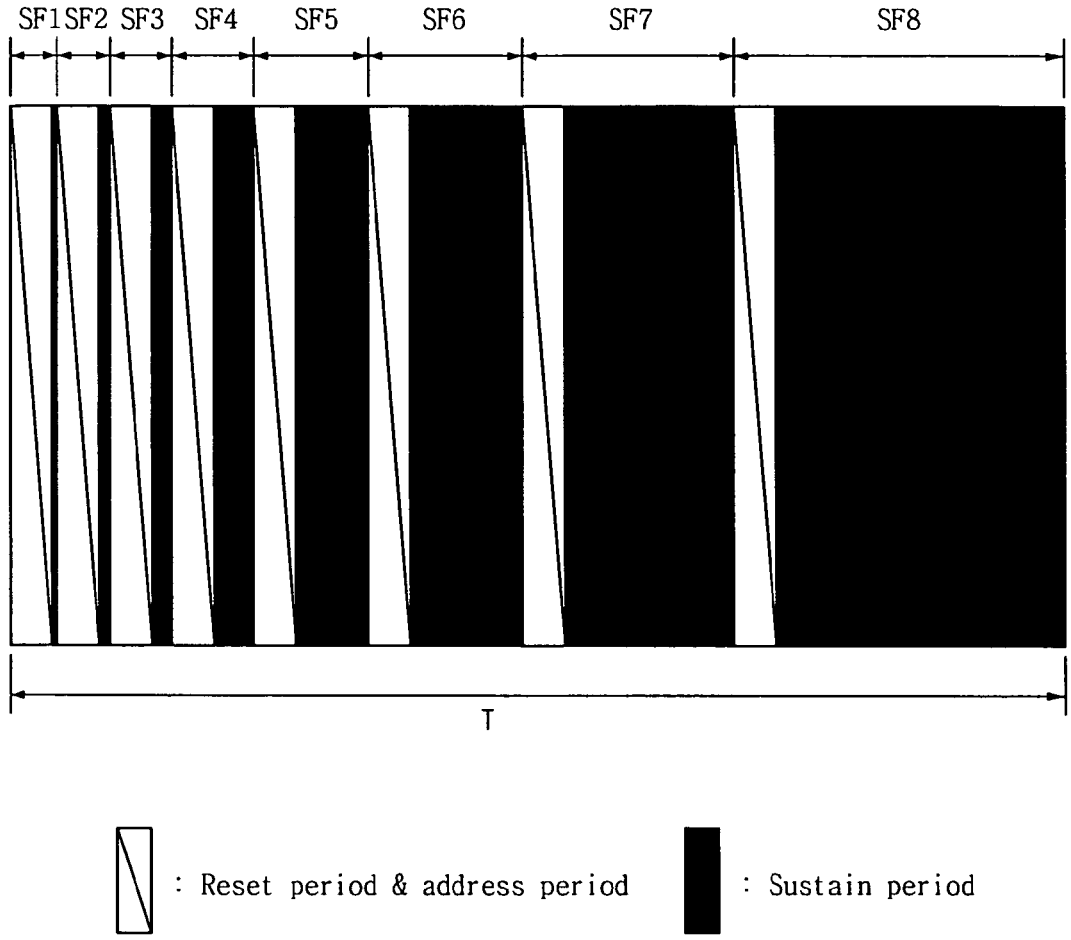
FIG. 14 illustrates a frame for achieving a gray level of an image displayed by the plasma display apparatus according to one embodiment.

FIG. 14 illustrates a frame for achieving a gray level of an image displayed by the plasma display apparatus according to one embodiment.

Figure 15:
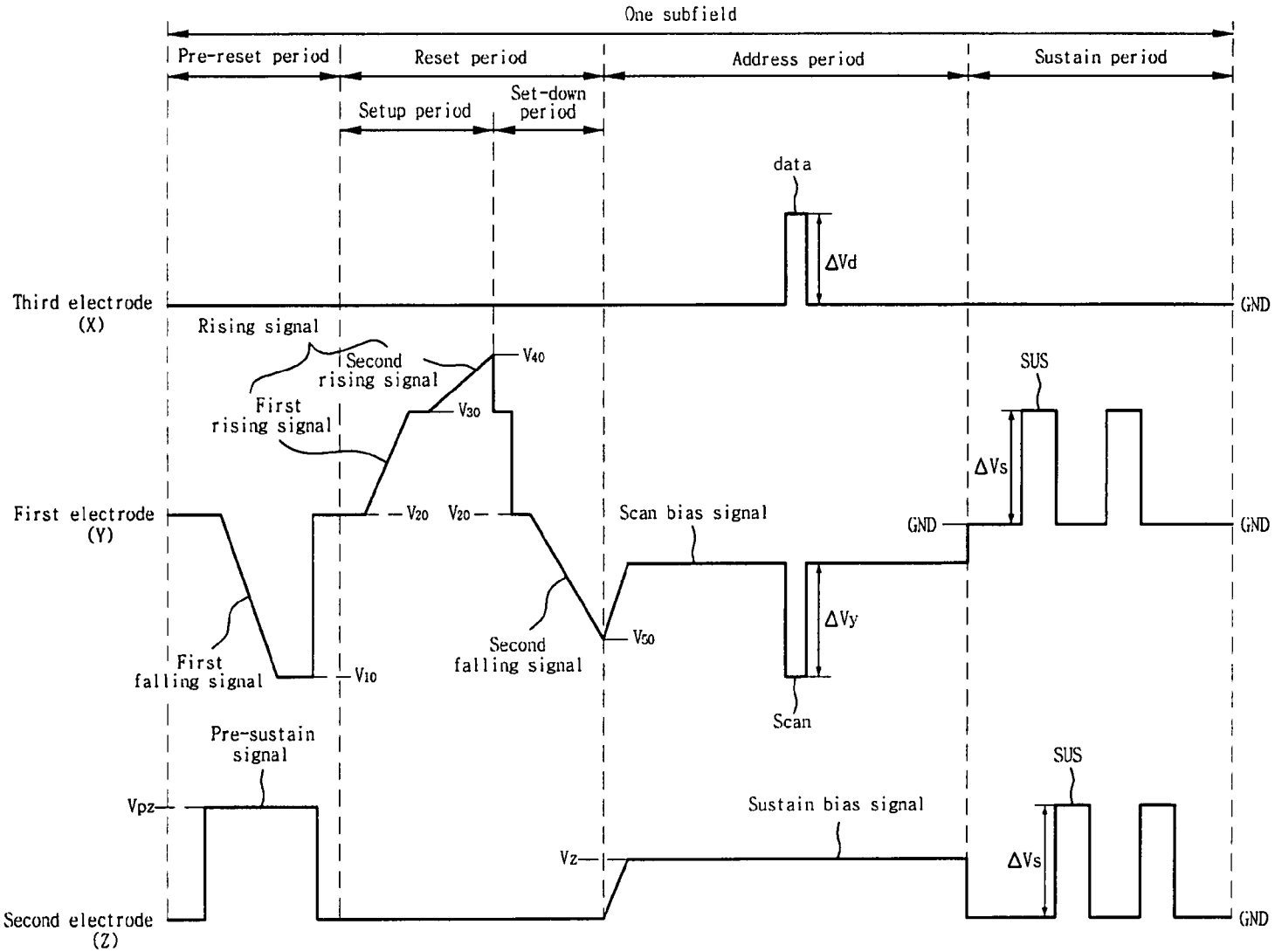
FIG. 15 illustrates one example of an operation of the plasma display apparatus according to one embodiment.

FIG. 15 illustrates one example of an operation of the plasma display apparatus according to one embodiment.

Referring to FIG. 14, a frame for achieving a gray level of an image displayed by the plasma display apparatus according to one embodiment is divided into several subfields each having a different number of emission times.

Each subfield is subdivided into a reset period for initializing all the cells, an address period for selecting cells to be discharged, and a sustain period for representing gray level in accordance with the number of discharges.

For example, if an image with 256-level gray level is to be displayed, a frame, as illustrated in FIG. 14, is divided into 8 subfields SF1 to SF8. Each of the 8 subfields SF1 to SF8 is subdivided into a reset period, an address period, and a sustain period.

The number of sustain signals supplied during the sustain period determines gray level weight in each of the subfields. For example, in such a method of setting gray level weight of a first subfield to $2^0$ and gray level weight of a second subfield to $2^1$, the sustain period increases in a ratio of $2^n$ (where, n=0, 1, 2, 3, 4, 5, 6, 7) in each of the subfields. Since the sustain period varies from one subfield to the next subfield, a specific gray level is achieved by controlling the sustain period which are to be used for discharging each of the selected cells, i.e., the number of sustain discharges that are realized in each of the discharge cells.

The plasma display apparatus according to one embodiment uses a plurality of frames to display an image during 1 second. For example, 60 frames are used to display an image during 1 second. In this case, a duration T of time of one frame may be 1/60 seconds, i.e., 16.67 ms.

Although FIG. 14 has illustrated and described a case where one frame includes 8 subfields, the number of subfields constituting one frame may vary. For example, one frame may include 12 subfields or 10 subfields.

Further, although FIG. 14 has illustrated and described the subfields arranged in increasing order of gray level weight, the subfields may be arranged in decreasing order of gray level weight, or the subfields may be arranged regardless of gray level weight.

FIG. 15 illustrates one example of an operation of the plasma display apparatus according to one embodiment in one subfield of a plurality of subfields of one frame as illustrated in FIG. 14.

During a pre-reset period prior to a reset period, the driver 1210 of FIG. 13 supplies a falling signal with a gradually falling voltage (i.e., a first falling signal) to a first electrode Y.

During the supplying of the first falling signal to the first electrode Y, the driver 1210 supplies a pre-sustain signal of a polarity direction opposite a polarity direction of the first falling signal to a second electrode Z.

The first falling signal supplied to the first electrode Y gradually falls from a ground level voltage GND to a tenth voltage V10.

The pre-sustain signal is constantly maintained at a pre-sustain voltage Vpz. The pre-sustain voltage Vpz is substantially equal to a voltage (i.e., a sustain voltage Vs) of a sustain signal (SUS) which will be supplied during a sustain period.

As above, during the pre-reset period, the first falling signal is supplied to the first electrode Y and the pre-sustain signal is supplied to the second electrode Z. As a result, wall charges of a predetermined polarity are accumulated on the first electrode Y, and wall charges of a polarity opposite the polarity of the wall charges accumulated on the first electrode Y are accumulated on the second electrode Z. For example, wall charges of a positive polarity are accumulated on the first electrode Y, and wall charges of a negative polarity are accumulated on the second electrode Z.

As a result, a setup discharge with a sufficient strength occurs during the reset period such that the initialization of all the discharge cells is performed stably.

Even if the amount of wall charges accumulated inside the discharge cell is not sufficient, a setup discharge with a sufficient strength occurs.

Furthermore, although a voltage of a rising signal supplied to the first electrode Y during the reset period is low, a setup discharge with a sufficient strength occurs.

A subfield, which is first arranged in time order in a plurality of subfields of one frame, may include a pre-reset period prior to a reset period so as to obtain sufficient driving time. Or, two or three subfields may include a pre-reset period prior to a reset period.

All the subfields may not include the pre-reset period.

The reset period is further divided into a setup period and a set-down period. During the setup period, the driver 1210 supplies the rising signal of a polarity direction opposite a polarity direction of the first falling signal to the first electrode Y.

The rising signal includes a first rising signal and a second rising signal. The first rising signal gradually rises from a twentieth voltage V20 to a thirtieth voltage V30 with a first slope, and the second rising signal gradually rises from the thirtieth voltage V30 to a fortieth voltage V40 with a second slope.

The rising signal generates a weak dark discharge (i.e., a setup discharge) inside the discharge cell during the setup period, thereby accumulating a proper amount of wall charges inside the discharge cell.

The second slope of the second rising signal is gentler than the first slope of the first rising signal. When the second slope is gentler than the first slope, the voltage of the rising signal rises relatively rapidly until the setup discharge occurs, and the voltage of the rising signal rises relatively slowly during the generation of the setup discharge. As a result, the quantity of light generated by the setup discharge is reduced. Accordingly, contrast of the plasma display apparatus is improved.

During the set-down period, the driver 1210 supplies a second falling signal of a polarity direction opposite a polarity direction of the rising signal to the first electrode Y. The second falling signal gradually falls from the twentieth voltage V20 to a fiftieth voltage V50. The second falling signal generates a weak erase discharge (i.e., a set-down discharge) inside the discharge cell. Furthermore, the remaining wall charges are uniform inside the discharge cells to the extent that an address discharge can be stably performed.

Figure 16A:
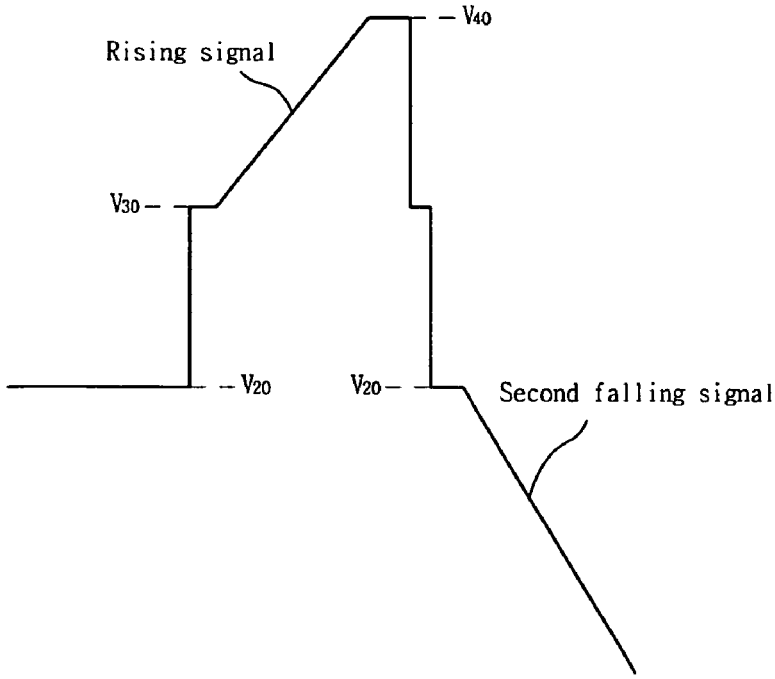
FIGS. 16*a* and 16*b* illustrate another form of a rising signal and a second falling signal.
Figure 16B:
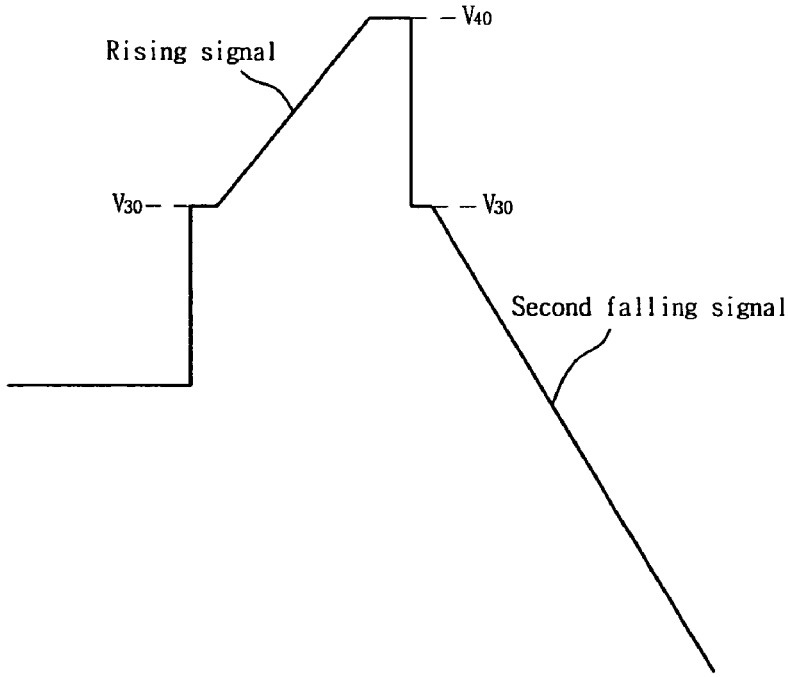

The following is a detailed description of another form of a rising signal and a second falling signal, with reference to FIGS. 16*a* and 16*b*.

FIGS. 16*a* and 16*b* illustrate another form of a rising signal and a second falling signal.

Referring to FIG. 16*a*, the rising signal sharply rises to the thirtieth voltage V30, and then gradually rises from the thirtieth voltage V30 to the fortieth voltage V40.

The rising signal illustrated in FIG. 15 may gradually rise with the two different slopes through two stages. However, the rising signal illustrated in FIG. 16*a* may gradually rise through one stage. As above, the rising signal may vary in the various forms.

Referring to FIG. 16*b*, the second falling signal gradually falls from the thirtieth voltage V30. As above, a voltage falling time point of the second falling signal is changeable. In other words, the second falling signal may vary in the various forms.

Referring again to FIG. 15, during the address period, the driver 1210 supplies a scan bias signal, which is maintained at a voltage higher than the fiftieth voltage V50 of the second falling signal, to the first electrode Y.

A scan signal (Scan), which falls from the scan bias signal by a scan voltage magnitude ΔVy, is supplied to all the first electrodes Y1 to Yn.

For example, a first scan signal (Scan 1) is supplied to the first electrode Y1, and then a second scan signal (Scan 2) is supplied to the first electrode Y2. Therefore, an n-th scan signal (Scan n) is supplied to the first electrode Yn.

The width of the scan signal may vary from one subfield to the next subfield. In other words, the width of a scan signal in at least one subfield may be different from the width of a scan signal in the other subfields. For example, the width of a scan signal in a subfield may be more than the width of a scan signal in the next subfield in time order. Further, the width of the scan signal may be gradually reduced in the order of 2.6 μs, 2.3 μs, 2.1 μs, 1.9 μs, etc., or in the order of 2.6 μs, 2.3 μs, 2.3 μs, 2.1 μs, 1.9 μs, 1.9 μs, etc.

As above, when the scan signal (Scan) is supplied to the first electrode Y, a data signal (data) corresponding to the scan signal (Scan) is supplied to the third electrode X. The data signal (data) rises from a ground level voltage GND by a data voltage magnitude ΔVd.

As the voltage difference between the scan signal (Scan) and the data signal (data) is added to the wall voltage generated during the reset period, the address discharge is generated within the discharge cell to which the data signal (data) is supplied.

A proper amount of wall charges remains to extent that a sustain discharge occurs when the sustain signal (SUS) is supplied inside the discharge cell selected by performing the address discharge.

A sustain bias signal is supplied to the second electrode Z during the address period to prevent the generation of the unstable address discharge by interference of the second electrode Z. The sustain bias signal is substantially maintained at a sustain bias voltage Vz. The sustain bias voltage Vz is lower than the voltage Vs of the sustain signal and is higher than the ground level voltage GND.

During the sustain period, a sustain signal (SUS) is alternately supplied to the first electrode Y and the second electrode Z. The sustain signal (SUS) has a voltage magnitude corresponding to the sustain voltage Vs.

As the wall voltage within the discharge cell selected by performing the address discharge is added to the sustain voltage Vs of the sustain signal (SUS), every time the sustain signal (SUS) is supplied, the sustain discharge, i.e., a display discharge occurs between the first electrode Y and the second electrode Z. Accordingly, a predetermined image is displayed on the plasma display panel.

Figure 17:
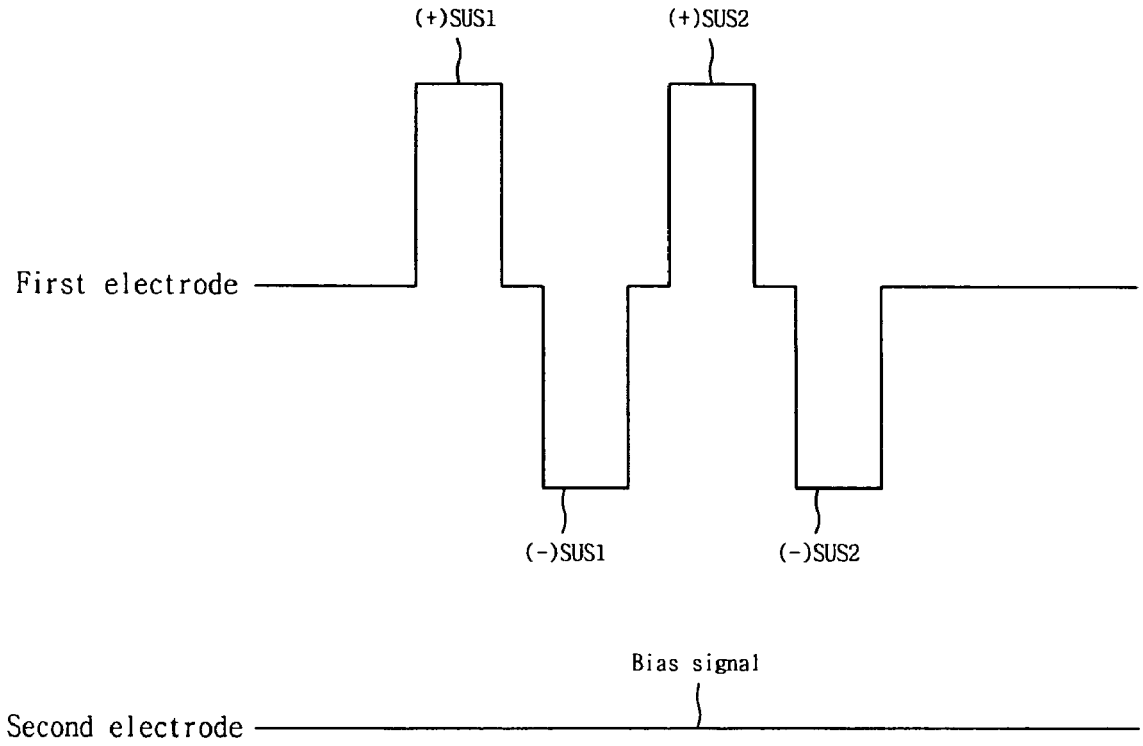
FIG. 17 illustrates another type of a sustain signal.

FIG. 17 illustrates another type of a sustain signal.

Referring to FIG. 17, a sustain signal ((+)SUS1, (+)SUS2) of a positive polarity direction and a sustain signal ((−)SUS1, (−)SUS2) of a negative polarity direction are alternately supplied to either the first electrode Y or the second electrode Z, for example, to the first electrode Y in FIG. 17.

As above, when the sustain signal of the positive polarity direction and the sustain signal of the negative polarity direction are alternately supplied to the first electrode Y, a bias signal is supplied to the second electrode Z. The bias signal is constantly maintained at the ground level voltage GND.

As above, the sustain signal may vary in various forms.

Further, when the sustain signal (SUS) is supplied to either the first electrode Y or the second electrode and the bias signal is supplied to the other electrode during the sustain period, the configuration of the driver is simplified.

As illustrated in FIG. 17, when the sustain signal is supplied to either the first electrode Y or the second electrode Z, a single diving board for installing a circuit for supplying the sustain signal (SUS) to either the first electrode Y or the second electrode Z is required. Accordingly, the whole size of the driver is reduced such that the manufacturing cost is reduced.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures. Moreover, unless the term "means" is explicitly recited in a limitation of the claims, such limitation is not intended to be interpreted under 35 USC 112(6).

What is claimed is:

1. A plasma display apparatus comprising:

a plasma display panel, wherein a discharge gas filled in the plasma display panel contains at least 10% xenon (Xe) by weight; and a filter positioned in front of the plasma display panel, the filter including:

a base portion, and a pattern portion formed on the base portion and having a color darker than a color of the base portion, wherein a refraction index of the pattern portion is less than a refraction index of the base portion.

2. The plasma display apparatus of claim 1, wherein a Xe content in the discharge gas ranges from 13% to 30% by weight.

3. The plasma display apparatus of claim 1, wherein the filter is adhered to a front surface of the plasma display panel.

4. The plasma display apparatus of claim 1, wherein the filter is spaced apart from the plasma display panel by a predetermined distance.

5. The plasma display apparatus of claim 1, wherein a direction along which the pattern portion extends and a side of the base portion form a predetermined angle, and the predetermined angle ranges from 0.5° to 9°.

6. The plasma display apparatus of claim 1, wherein a height of the pattern portion ranges from 0.89 to 4.25 times a smallest gap between two adjacent pattern portions.

7. The plasma display apparatus of claim 1, wherein a refractive index of the pattern portion ranges from 0.8 to 0.999 times a refractive index of the base portion.

8. The plasma display apparatus of claim 1, wherein an upper area of the pattern portion is farther from the plasma display panel than a bottom area of the pattern portion, and an upper width of the pattern portion in the upper area is less than a lower width of the pattern portion in the bottom area.

9. The plasma display apparatus of claim 1, wherein a height of the base portion ranges from 1.01 to 2.25 times a height of the pattern portion.

10. The plasma display apparatus of claim 1, wherein a smallest gap between two adjacent pattern portions ranges from 1.1 to 5 times a width of a bottom portion of the pattern portion.

11. The plasma display apparatus of claim 1, wherein a largest gap between two adjacent pattern portions ranges from 1.1 to 3.25 times a smallest gap between two adjacent pattern portions.

12. The plasma display apparatus of claim 1, further comprising at least one buffer positioned between the plasma display panel and the filter.

13. The plasma display apparatus of claim 12, wherein a thickness of the buffer ranges from 200 μm to 400 μm.

14. The plasma display apparatus of claim 12, wherein the buffer includes a resin material or a glass material.

15. A plasma display apparatus comprising:

a plasma display panel, wherein a discharge gas filled in the plasma display panel contains at least 10% xenon (Xe) by weight; and a filter positioned in front of the plasma display panel, the filter including:

a base portion, and a pattern portion formed on the base portion, wherein a height of the base portion ranges from 1.01 to 2.25 times a height of the pattern portion, wherein a refraction index of the pattern portion is less than a refraction index of the base portion.

16. The plasma display apparatus of claim 15, wherein a color of the pattern portion is darker than a color of the base portion.

17. The plasma display apparatus of claim 15, wherein a direction along which the pattern portion extends and a side of the base portion form a predetermined angle, and the predetermined angle ranges from 0.5° to 9°.

18. A plasma display apparatus comprising:

a plasma display panel, on which an image is displayed, wherein a discharge gas filled in the plasma display panel contains xenon (Xe) equal to or more than 10% based on total weight of the discharge gas, the plasma display panel including:

a front substrate on which a first electrode and a second electrode are formed in parallel to each other, and a rear substrate on which a third electrode is formed to intersect the first electrode and the second electrode; and a filter positioned in front of the plasma display panel, the filter including:

a base portion, and a pattern portion formed on the base portion, wherein a lower width of the pattern portion is less than the closest distance between the first electrode and the second electrode.

* * * * *